US009796400B2

(12) United States Patent
Puttagunta et al.

(10) Patent No.: US 9,796,400 B2
(45) Date of Patent: Oct. 24, 2017

(54) REAL TIME MACHINE VISION AND POINT-CLOUD ANALYSIS FOR REMOTE SENSING AND VEHICLE CONTROL

(71) Applicant: Solfice Research, Inc., Albany, CA (US)

(72) Inventors: Shanmukha Sravan Puttagunta, Berkeley, CA (US); Fabien Chraim, Berkeley, CA (US); Anuj Gupta, Berkeley, CA (US); Scott Harvey, San Francisco, CA (US); Jason Creadore, Berkeley, CA (US); Graham Mills, Berkeley, CA (US)

( * ) Notice: Subject to any disclaimer, the term of this patent is extended or adjusted under 35 U.S.C. 154(b) by 0 days.

(21) Appl. No.: 15/002,380

(22) Filed: Jan. 20, 2016

(65) Prior Publication Data

US 2016/0221592 A1 Aug. 4, 2016

Related U.S. Application Data

(63) Continuation-in-part of application No. 14/555,501, filed on Nov. 26, 2014, now abandoned.

(60) Provisional application No. 61/909,525, filed on Nov. 27, 2013, provisional application No. 62/105,696, filed on Jan. 20, 2015.

(51) Int. Cl.

| | |
|---|---|
| ***B61L 23/24*** | (2006.01) |
| ***B61L 23/34*** | (2006.01) |
| ***B61L 25/04*** | (2006.01) |
| ***B61L 23/04*** | (2006.01) |
| ***B61L 25/02*** | (2006.01) |
| ***B61L 27/04*** | (2006.01) |

(52) U.S. Cl.

CPC ..... *B61L 23/34* (2013.01); *B61L 23/041* (2013.01); *B61L 25/025* (2013.01); *B61L 25/04* (2013.01); *B61L 27/04* (2013.01); *B61L 2205/04* (2013.01)

(58) Field of Classification Search

CPC ..... B61L 23/34; G06K 9/00

See application file for complete search history.

(56) References Cited

U.S. PATENT DOCUMENTS

| | | | | |
|---|---|---|---|---|
| 6,218,961 | B1 * | 4/2001 | Gross | B60T 7/22 246/122 R |
| 7,593,963 | B2 * | 9/2009 | Ballesty | B61L 27/0094 |
| 8,817,021 | B1 * | 8/2014 | Hickman | G06T 15/00 345/420 |

(Continued)

OTHER PUBLICATIONS

International Search Report and Written Opinion in International Patent Application No. PCT/US16/14196, issued Aug. 30, 2016.

*Primary Examiner* — Jonathan M Dager
*Assistant Examiner* — Alex C Dunn
(74) *Attorney, Agent, or Firm* — Brad Bertoglio

(57) ABSTRACT

Methods and apparatus for real time machine vision and point-cloud data analysis are provided, for remote sensing and vehicle control. Point cloud data can be analyzed via scalable, centralized, cloud computing systems for extraction of asset information and generation of semantic maps. Machine learning components can optimize data analysis mechanisms to improve asset and feature extraction from sensor data. Optimized data analysis mechanisms can be downloaded to vehicles for use in on-board systems analyzing vehicle sensor data. Semantic map data can be used locally in vehicles, along with onboard sensors, to derive precise vehicle localization and provide input to vehicle to control systems.

6 Claims, 20 Drawing Sheets

(56) References Cited

U.S. PATENT DOCUMENTS

| | | | | |
|---|---|---|---|---|
| 8,868,335 | B2 | 10/2014 | Nowak et al. | |
| 9,245,170 | B1 * | 1/2016 | Nikic | G01S 17/89 |
| 2002/0169778 | A1 | 11/2002 | Natesan et al. | |
| 2004/0249571 | A1 * | 12/2004 | Blesener | B61L 29/28 701/301 |
| 2006/0244830 | A1 * | 11/2006 | Davenport | B61L 25/021 348/148 |
| 2008/0255754 | A1 | 10/2008 | Pinto | |
| 2009/0105893 | A1 * | 4/2009 | Kernwein | B61L 25/025 701/19 |
| 2010/0104199 | A1 | 4/2010 | Ihang | |
| 2011/0216063 | A1 | 9/2011 | Hayes | |
| 2011/0285842 | A1 * | 11/2011 | Davenport | B61L 23/04 348/116 |
| 2012/0294532 | A1 * | 11/2012 | Morris | G06F 17/30241 382/195 |
| 2013/0096886 | A1 * | 4/2013 | Vorobyov | G01C 11/00 703/1 |
| 2013/0334373 | A1 | 12/2013 | Malone et al. | |
| 2014/0067187 | A1 | 3/2014 | Ferguson et al. | |
| 2014/0358414 | A1 * | 12/2014 | Ibrahim | G01C 21/10 701/118 |
| 2014/0379254 | A1 | 12/2014 | Miksa et al. | |
| 2015/0019124 | A1 * | 1/2015 | Bandyopadhyay | G01C 17/38 701/410 |

* cited by examiner

REAL TIME MACHINE VISION AND POINT-CLOUD ANALYSIS FOR REMOTE SENSING AND VEHICLE CONTROL

CROSS REFERENCE TO RELATED APPLICATIONS

The present application is a continuation-in-part of U.S. patent application Ser. No. 14/555,501, entitled Real Time Machine Vision System for Train Control and Protection, filed Nov. 26, 2014, and incorporated by reference in its entirety; which claims the benefit of U.S. provisional patent application No. 61/909,525, entitled Systems and Methods for Train Control Using Locomotive Mounted Computer Vision, filed Nov. 27, 2013, and incorporated by reference in its entirety. The application also claims the benefit of, priority to, and incorporates by reference, in its entirety, the following provisional patent application under 35 U.S.C. Section 119(e): 62/105,696, entitled A Scalable Approach To Point-Cloud Data Processing for Railroad Asset Location and Health Monitoring, filed Jan. 20, 2015.

BACKGROUND

The automated localization of moving vehicles and machine-based remote sensing of vehicle local environment is becoming increasingly important in several different disciplines. One such discipline is automotive transportation. In recent years, many cars and trucks implement onboard Global Positioning System (GPS) receivers and navigation systems utilizing GPS data for driver guidance. However, as automobile manufacturers seek to implement more advanced driving automation, such as autonomous driving features, GPS-based location systems may not be able to provide sufficiently accurate vehicle localization, nor do they allow for real-time sensing of a vehicle's local environment. Therefore, supplemental sensing systems may be desirable, as well as highly detailed infrastructure and landmark maps, potentially including three-dimensional semantic maps.

Another application in which vehicle localization, sensing of a local environment and three-dimensional semantic maps may be desirable is in the operation of trains. The U.S. Congress passed the U.S. Rail Safety Improvement Act in 2008 to ensure all trains are monitored in real time to enable "Positive Train Control" (PTC). This law requires that all trains report their location information such that all train movements are tracked in real time. PTC is required to function both in signaled territories and dark territories.

In order to achieve this milestone, numerous companies have tried to implement various PTC systems. A reoccurring problem is that current PTC systems can only track a train when it passes by wayside transponders or signaling stations along a railway line, rendering the operators unaware of the status of the train in between wayside signals. Therefore, the distance between consecutive physical wayside signaling infrastructures determines the minimum safe distance required between trains (headway). Current signaling infrastructure also limits the scope of deploying wayside signaling equipment due to the cost and complexity of constructing and maintaining PTC infrastructure along the length of the railway network. The current methodology for detecting trains the last time they passed near a wayside detector suffers from a lack of position information in-between transponders.

Certain companies went a step further to utilize radio towers along the length of the operator's track network to create virtual signals between trains, circumventing the need for wayside signaling equipment. Radio towers still require signaling equipment to be deployed in order for the radio communication to take place. However, for dependable location information, additional transponders have to be deployed along tracks for the train to reliably determine the position of the train and the track it is currently occupying.

One example of a PTC system in use is the European Train Control System (ETCS) which relies on trackside equipment and a train-mounted control that reacts to the information related to the signaling. That system relies heavily on infrastructure that has not been deployed in the United States or in developing countries.

A solution that requires minimal deployment of wayside signaling equipment would be beneficial for establishing Positive Train Control throughout the United States and in the developing world. Deploying millions of balises—the transponders used to detect and communicate the presence of trains and their location—every 1-15 km along tracks is less effective because balises are negatively affected by environmental conditions, theft, and require regular maintenance, and the data collected may not be used in real time. Obtaining positional data through only trackside equipment is not a scalable solution considering the costs of utilizing balises throughout the entire railway network PTC. Moreover, train control and safety systems cannot rely solely on a global positioning system (GPS) as it not sufficiently accurate to distinguish between tracks, thereby requiring wayside signaling for position calibration.

As autonomous driving, train control and other vehicle operating systems evolve, these and other challenges may be addressed by systems and methods described hereinbelow.

SUMMARY

In accordance with one aspect disclosed herein, systems and methods are described for localization and/or control of a vehicle, such as a train or automobile. Local environment sensors, which may include a machine vision system such as LiDAR, can be mounted on a vehicle. A GPS receiver may also be included to provide a first geographical position of the vehicle. A remote database and processor stores and processes data collected from multiple sources, and an on-board vehicle processor downloads data relevant for operation, safety, and/or control of the moving vehicle. The local environmental sensors generate data describing a surrounding environment, such as point-cloud data generated by a LiDAR sensor. Collected data can be processed locally, on board the vehicle, or uploaded to a remote data system for storage, processing and analysis. Analysis mechanisms (on-board and/or implemented in remote data systems) can operate on the collected data to extract information from the sensor data, such as the identification and position of objects in the local environment.

An exemplary embodiment of a system described herein includes a hardware component mounted on railroad or other vehicles, a remote database, and analysis components to process data collected regarding information about a transportation system, including moving and stationary vehicles, infrastructure, and transit pathway (e.g. rail or road) condition. The system can accurately estimate the precise position of the vehicle traveling down the transit pathway, such as by comparing the location of objects detected in the vehicle's on-board sensors relative to the known location of objects. Additional attributes about the exemplary components are detailed herein and include the following:

The Hardware: informs the movement of vehicles for safety, including: in railroad applications, identifying the track upon which they are traveling, obstructions, health of track and rail system, among other features; and in automotive applications, the lane upon which the vehicle is traveling, the texture and health of the road, the identification of assets in the vicinity, amongst other features.

The Remote Database: contains information about assets, and which can be queried remotely to obtain additional asset information.

Database Population With Asset Information: methods include machine vision data collected by the traveling vehicle itself, or by another vehicle (such as road-rail vehicles, track inspection vehicles, aerial vehicles, mobile mapping platforms, etc.). This data is then processed to generate the asset information (location, features, road/track health, among other information).

Data Analysis Mechanisms: fuse together several data and information streams (e.g. from the sensors, the database, wayside units, the vehicle's information bus, etc.) to result in an accurate estimate of the lane, track ID or other indicia of localization.

These and other aspects of the disclosure will be apparent in view of the text and drawings provided herein.

BRIEF DESCRIPTION OF THE DRAWINGS

Exemplary embodiments will now be further described with reference to the drawings, wherein like designations denote like elements, and.

DETAILED DESCRIPTION

In accordance with one embodiment, methods and apparatuses are provided for determining the position of one or more moving vehicles, e.g., trains or autonomous driving vehicles, without depending on balises/transponders distributed throughout the operating environment for accurate positional data. Some train-based implementations of such embodiments are sometimes referred to herein as BVRVB-PTC, a PTC vision system, or a machine vision system.

Also disclosed are solutions to use that positional data to optimize vehicle control and operation, such as the operation of the trains within a rail system. Railway embodiments can use a series of sensor fusion and data fusion techniques to obtain the track position with improved precision and reliability. Such embodiments can also be used for auto-braking of trains for committing red light violations on the track, for optimizing fuel based on terrain, synchronizing train speeds to avoid red lights, anti-collision systems, and for preventative maintenance of not only the trains, but also the tracks, rails, and gravel substrate underlying the tracks. Some embodiments may use a backend processing and storage component for keeping track of asset location and health information (accessible by the moving vehicle or by railroad operators through reports).

In addition to localization, it may be desirable for autonomous driving embodiments to take advantage of highly detailed infrastructure and landmark maps. These maps can be utilized to direct the flow of traffic in the real world and plan routes for vehicles to travel from source to destination. The three-dimensional nature of the maps, in addition to their accuracy in representing the physical world, assist the vehicles in anticipating events beyond their sensing range, foveating their sensors to the assets of interest, and localizing the vehicles in relation to the landmarks. By utilizing highly detailed three-dimensional (semantic) maps for the pseudo-static assets, the vehicle's resources are liberated to observe the dynamic objects around it.

The PTC vision system may include modules that handle communication, image capture, image processing, computational devices, data aggregation platforms that interface with the train signal bus and inertial sensors (including on-board and positional sensors).

Figure 1:
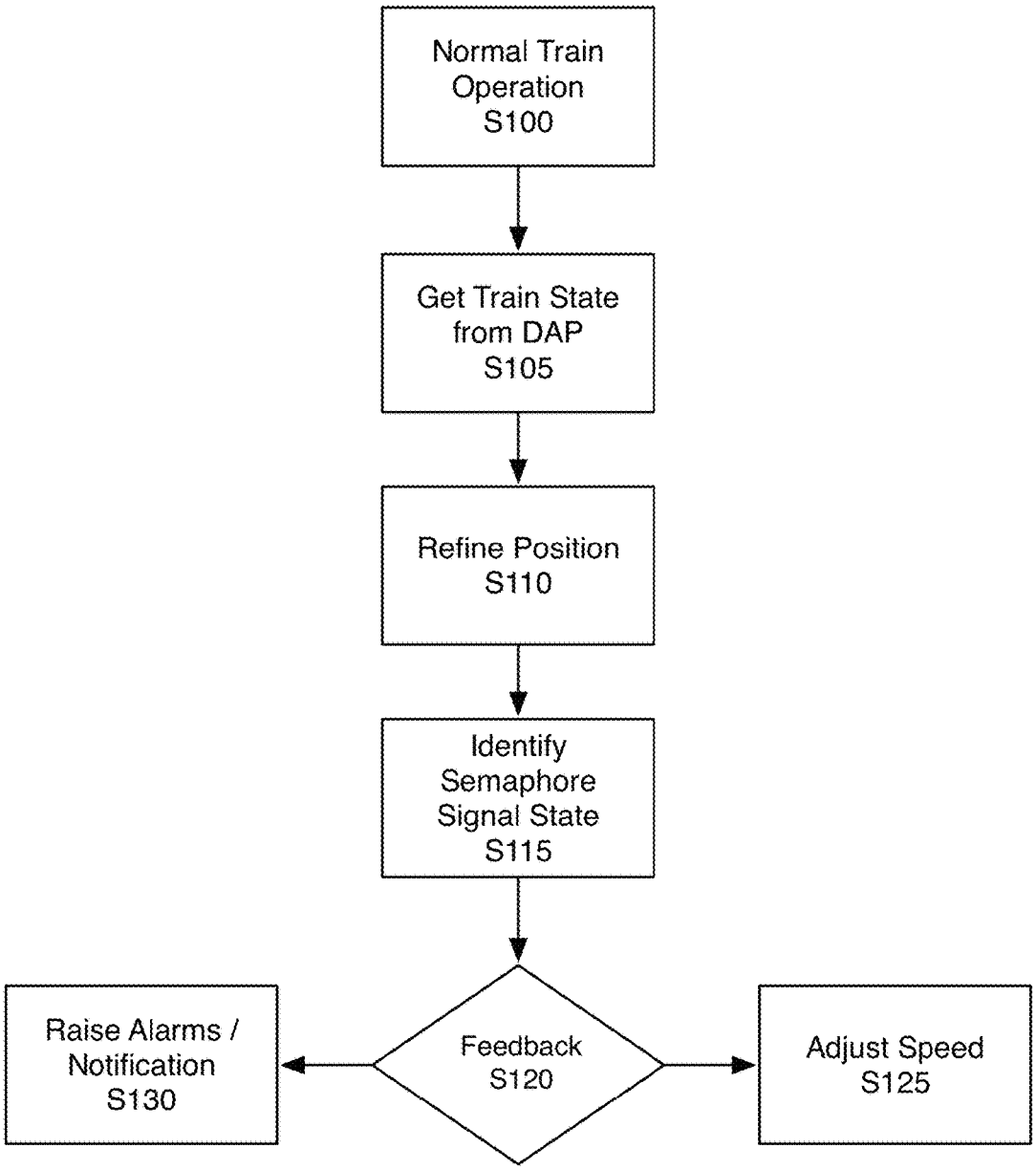
FIG. 1 is a representative flow diagram of a Train Control System.

FIG. 1 illustrates an exemplary flow operation of a Train Control System. In step S100, a train undergoes normal operation. In step S105, the train state is retrieved from the Data Aggregation Platform (described below). In step S110, the train position is refined. In step S115, semaphore signal states are identified from local environment sensor information. In step S120, feedback is applied. The train speed can be adjusted (step S125), alarms and/or notifications can be raised (step S130). Further detail concerning of each of these steps is described hereinbelow.

Figure 2:
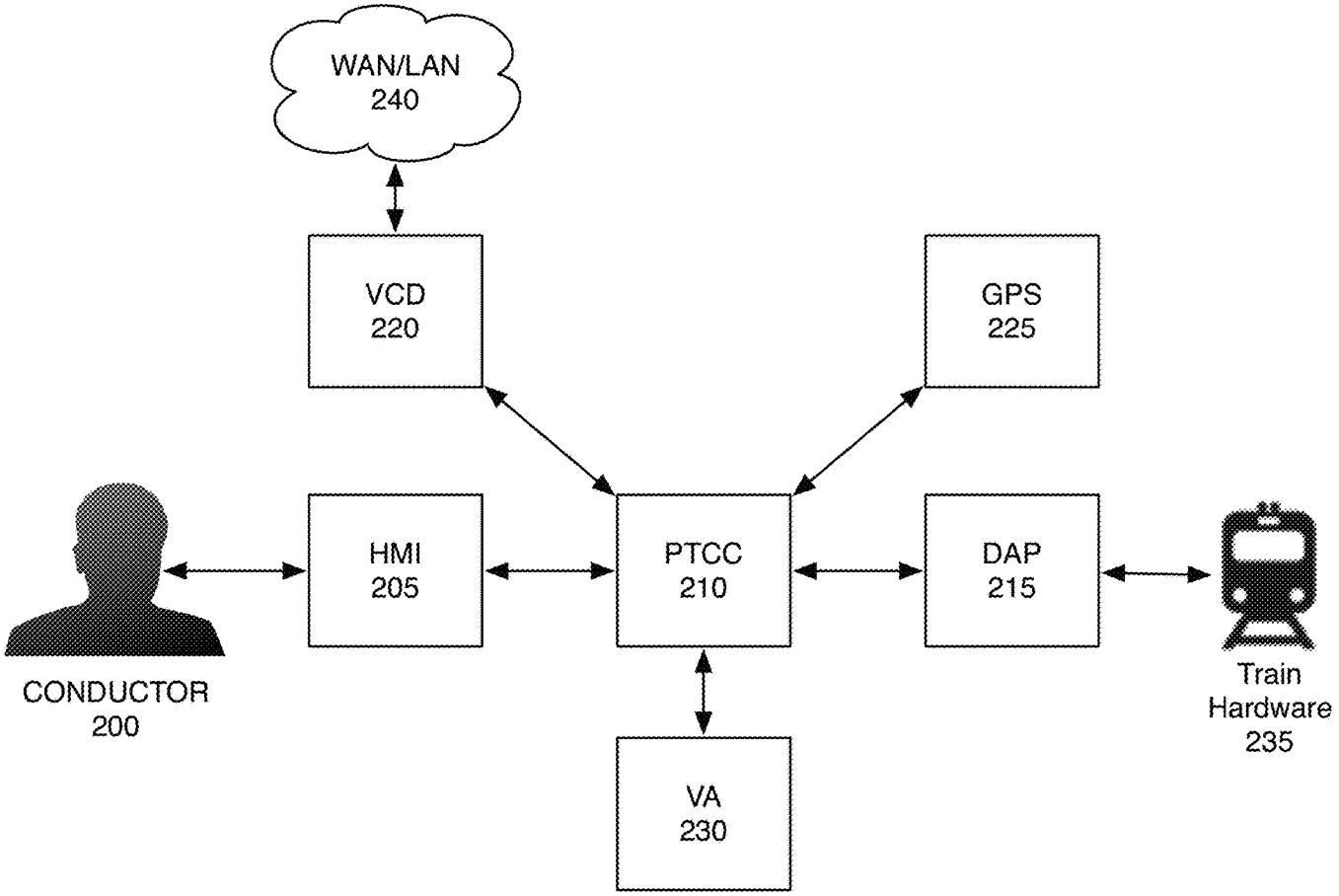
FIG. 2 is a representative flow diagram of the on board ecosystem.

Referring to FIG. 2, a PTC vision system may include one or more of the following: Data Aggregation Platform (DAP) 215, Vision Apparatus (VA) 230, Positive Train Control Computer (PTCC) 210, Human Machine Interface (HMI) 205, GPS Receiver 225, and the Vehicular Communication Device (VCD) 220, typically communicating via LAN or WAN communications network 240.

The components (e.g., VCD, HMI, PTCC, VA, DAP, GPS) may be integrated into a single component or be modular in nature and may be virtual software or a physical hardware device. Each component in the PTC vision system may have its own power supply or share one with the PTCC. The power supplies used for the components in the PTC vision system may include non-interruptible components for power outages.

The PTCC module maintains the state of information passing in between the modules of the PTC vision system. The PTCC communicates with the HMI, VA, VCD, GPS, and DAP. Communication may include providing information (e.g., data) and/or receiving information. An interface (e.g., bus, connection) between any module of the ecosystem may include any conventional interface. Modules of the ecosystem may communicate with each other, a human operator, and/or a third party (e.g., another train, conductor, train operator) using any conventional communication protocol. Communication may be accomplished via wired and/or wireless communication link (e.g., channel).

The PTCC may be implemented using any conventional processing circuit including a microprocessor, a computer, a signal processor, memory, and/or buses. A PTCC may perform any computation suitable for performing the functions of the PTC vision system.

The HMI module may receive information from the PTCC module. Information received by the HMI module may include: Geolocation (e.g., GPS Latitude & Longitude coordinates); Time; Recommended speeds; Directional Heading (e.g., azimuth); Track ID; Distance/headway between neighboring trains on the same track; Distance/headway between neighboring trains on adjacent tracks; Stations of interest, including Next station, Previous station, or Stations between origin and destination; State of virtual or physical semaphore for current track segment utilized by a train; State of virtual or physical semaphore for upcoming and previous track segments in a train's route; and State of virtual or physical semaphore for track segments which share track interlocks with current track.

The HMI module may provide information to the PTCC module. Information provided to the PTCC may include information and/or requests from an operator. The HMI may process (e.g., format, reduce, adjust, correlate) information prior to providing the information to an operator or the PTCC module. The information provided by the HMI to the PTCC module may include: Conductor commands to slow down the train; Conductor requests to bypass certain parameters (e.g., speed restrictions); Conductor acknowledgement of messages (e.g., faults, state information); Conductor requests for additional information (e.g., diagnostic procedures, accidents along the railway track, or other points of interest along the railway track); and Any other information of interest relevant to a conductor's train operation.

The HMI provides a user interface (e.g., GUI) to a human user (e.g., conductor, operator). A human user may operate controls (e.g., buttons, levers, knobs, touch screen, keyboard) of the HMI module to provide information to the HMI module or to request information from the vision system. An operator may wear the user interface to the HMI module. The user interface may communicate with the HMI module via tactile operation, wired communication, and/or wireless communication. Information provided to a user by the HMI module may include: Recommended speed, Present speed, Efficiency score or index, Driver profile, Wayside signaling state, Stations of interest, Map view of inertial metrics, Fault messages, Alarms, Conductor interface for actuation of locomotive controls, and Conductor interface for acknowledgement of messages or notifications.

The VCD module performs communication (e.g., wired, wireless). The VCD module enables the PTC vision system to communicate with other devices on and off the train. The VCD module may provide Wide Area Network ("WAN") and/or Local Area Network ("LAN") communications. WAN communications may be performed using any conventional communication technology and/or protocol (e.g., cellular, satellite, dedicated channels). LAN communications may be performed using any conventional communication technology and/or protocol (e.g., Ethernet, WiFi, Bluetooth, WirelessHART, low power WiFi, Bluetooth low energy, fibre optics, IEEE 802.15.4e). Wireless communications may be performed using one or more antennas suitable to the frequency and/or protocols used.

The VCD module may receive information from the PTCC module. The VCD may transmit information received from the PTCC module. Information may be transmitted to headquarters (e.g., central location), wayside equipment, individuals, and/or other trains. Information from the PTCC module may include: Packets addressed to other trains; Packets addressed to common backend server to inform operators of train location; Packets addressed to wayside equipment; Packets addressed to wayside personnel to communicate train location; Any node to node arbitrary payload; and Packets addressed to third party listeners of PTC vision system.

The VCD module may also provide information to the PTCC module. The VCD may receive information from any source to which the VCD may transmit information. Information provided by the VCD to the PTCC may include: Packets addressed from other trains; Packets addressed from common backend server to give feedback to a conductor or a train; Packets addressed from wayside equipment; Packets addressed from wayside personnel to communicate personnel location; Any node to node arbitrary payload; and Packets addressed from third party listeners of PTC vision system.

The GPS modules may include a conventional global positioning system ("GPS") receiver. The GPS module receives signals from GPS satellites and determines a geographical position of the receiver and time (e.g., UTC time) using the information provided by the signals. The GPS module may include one or more antennas for receiving the signals from the satellites. The antennas may be arranged to reduce and/or detect multipath signals and/or error. The GPS module may maintain a historical record of geographical position and/or time. The GPS module may determine a speed and direction of travel of the train. A GPS module may receive correction information (e.g., WAAS, differential) to improve the accuracy of the geographic coordinates determined by the GPS receiver. The GPS module may provide information to PTCC module. The information provided by the GPS module may include: Time (e.g., UTC, local); Geographic coordinates (e.g., latitude & longitude, northing & easting); Correction information (e.g., WAAS, differential); Speed; and Direction of travel.

The DAP may receive (e.g., determine, detect, request) information regarding a train, the systems (e.g., hardware, software) of a train, and/or a state of operation of a train (e.g., train state). For example, the DAP may receive information from the systems of a train regarding the speed of the train, train acceleration, train deceleration, braking effort (e.g., force applied), brake pressure, brake circuit status, train wheel traction, inertial metrics, fluid (e.g., oil, hydraulic) pressures, and energy consumption. Information from a train may be provided via a signal bus used by the train to transport information regarding the state and operation of the systems of the train. A signal bus includes one or more conventional signal busses such as Fieldbus (e.g., IEC 61158), Multifunction Vehicle Bus ("MVB"), wire train bus ("WTB"), controller area network bus ("CanBUS"), Train Communication Network ("TCN") (e.g., IEC 61375), and Process Field Bus ("Profibus"). A signal bus may include devices that perform wired and/or wireless (e.g., TTEthernet) communication using any conventional and/or proprietary protocol.

The DAP may further include any conventional sensor to detect information not provided by the systems of the train. Sensors may be deployed (e.g., attached, mounted) at any location on the train. Sensors may provide information to the DAP directly and/or via another device or bus (e.g., signal bus, vehicle control unit, wide train bus, multifunction vehicle bus). Sensors may detect any physical property (e.g., density, elasticity, electrical properties, flow, magnetic properties, momentum, pressure, temperature, tension, velocity, viscosity). The DAP may provide information regarding the train to the other modules of the PTC ecosystem via the PTCC module.

The DAP may receive information from any module of the PTC ecosystem via the PTCC module. The DAP may provide information received from any source to other modules of the PTC ecosystem via the PTCC module. Other modules may use information provided by or through the DAP to perform their respective functions.

The DAP may store received data. The DAP may access stored data. The DAP may create a historical record of received data. The DAP may relate data from one source to another source. The DAP may relate data of one type to data of another type. The DAP may process (e.g., format, manipulate, extrapolate) data. The DAP may store data that may be used, at least in part, to derive a signal state of the track on which the train travels, geographic position of the train, and other information used for positive train control.

The DAP may receive information from the PTCC module. Information received by the DAP from the PTCC module may include: Requests for train state data; Requests for braking interface state; Commands to actuate train behavior (speed, braking, traction effort); Requests for fault messages; Acknowledgement of fault messages; Requests to raise alarms in the train; Requests for notifications of alarms raised in the train; and Requests for wayside equipment state.

The DAP may provide information to the PTCC module. Information provided by the DAP to the PTCC module may include: Data from the signal bus of the train regarding train state; Acknowledge of requests; Fault messages on train bus; and Wayside equipment state.

The VA module detects the environment around the train. The VA module detects the environment through which a train travels. The VA module may detect the tracks upon which the train travels, tracks adjacent to the tracks traveled by the train, the aspect (e.g., appearance) of wayside (e.g., along tracks) signals (semaphore, mechanical, light, position), infrastructure (e.g., bridges, overpasses, tunnels), and/or objects (e.g., people, animals, vehicles). Additional examples include: PTC assets, ETCS assets, Tracks, Signals, Signal lights, Permanent speed restrictions, Catenary structures, Catenary wires, Speed limit Signs, Roadside safety structures, Crossings, Pavements at crossings, Clearance point locations for switches installed on the main and siding tracks, Clearance/structure gauge/kinematic envelope, Beginning and ending limits of track detection circuits in non-signaled territory, Sheds, Stations, Tunnels, Bridges, Turnouts, Cants, Curves, Switches, Ties, Ballast, Culverts, Drainage structures, Vegetation ingress, Frog (crossing point of two rails), Highway grade crossings, Integer mileposts, Interchanges, Interlocking/control point locations, Maintenance facilities, Milepost signs, and Other signs and signals.

The VA module may detect the environment using any type of conventional sensor that detects a physical property and/or a physical characteristic. Sensors of the VA module may include cameras (e.g., still, video), remote sensors (e.g., Light Detection and Ranging), radar, infrared, motion, and range sensors. Operation of the VA module may be in accordance with a geographic location of the train, track conditions, environmental conditions (e.g., weather), speed of the train. Operation of the VA may include the selection of sensors that collect information and the sampling rate of the sensors.

The VA module may receive information from the PTCC module. Information provided by the PTCC module may provide parameters and/or settings to control the operation of the VA module. For example, the PTCC may provide information for controlling the sampling frequency of one or more sensors of the VA. The information received by the VA from the PTCC module may include: The frequency of the sampling, The thresholds for the sensor data, and Sensor configurations for timing and processing.

The VA module may provide information to the PTCC module. The information provided by the VA module to the PTCC module may include: Present sensor configuration parameters, Sensor operational status, Sensor capability (e.g., range, resolution, maximum operating parameters), Raw or processed sensor data, Processing capability, and Data formats.

Raw or processed sensor data may include a point cloud (e.g., two-dimensional, three-dimensional), an image (e.g., jpg), a sequence of images, a video sequence (e.g., live, recorded playback), scanned map (e.g., two-dimensional, three-dimensional), an image detected by Light Detection and Ranging (e.g., LIDAR), infrared image, and/or low light image (e.g., night vision). The VA module may perform some processing of sensor data. Processing may include data reduction, data augmentation, data extrapolation, and object identification.

Sensor data may be processed, whether by the VA module and/or the PTCC module, to detect and/or identify: Track used by the train, Distance to tracks, objects and/or infrastructure, Wayside signal indication (e.g., meaning, message, instruction, state, status), Track condition (e.g., passable, substandard), Track curvature, Direction (e.g., turn, straight) of upcoming segment, Track deviation from horizontal (e.g., declivity, acclivity), Junctions, Crossings, Interlocking exchanges, Position of train derived from environmental information, and Track identity (e.g., track ID).

The VA module may be coupled (e.g., mounted) to the train. The VA module may be coupled at any position on the train (e.g., top, inside, underneath). The coupling may be fixed and/or adjustable. An adjustable coupling permits the viewpoint of the sensors of the VA module to be moved with respect to the train and/or the environment. Adjustment of the position of the VA may be made manually or automatically. Adjustment may be made responsive to a geographic position of the train, track condition, environmental conditions around the train, and sensor operational status.

The PTCC utilizes its access to all subsystems (e.g., modules) of the PTC system to derive (e.g., determine, calculate, extrapolate) track ID and signal state from the sensor data obtained from the VA module. In addition, the PTCC module may utilize the train operating state information, discussed above, and data from the GPS receiver to refine geographic position data. The PTCC module may also use information from any module of the PTC environment, including the PTC vision system, to qualify and/or interpret sensor information provided by the VA module. For example, the PTCC may use geographic position information from the GPS module to determine whether the infrastructure or signaling data detected by the VA corresponds to a particular location. Speed and heading (e.g., azimuth) information derived from video information provided by the VA module may be compared to the speed and heading information provided by the GPS module to verify accuracy or to determine likelihood of correctness. The PTCC may use images provided by the VA module with position information from the GPS module to prepare map information provided to the operator via the user interface of the HMI module. The PTCC may use present and historical data from the DAP to detect the position of the train using dead reckoning, position determination may be correlated to the location information provided by the VA module and/or GPS module. The PTCC may receive communications from other trains or wayside radio transponders (e.g., balises) via the VCD module for position determination that may be correlated and/or corrected (e.g., refined) using position information from the VA module and/or the GPS module or even dead reckoning position information from the DAP. Further, track ID, signal state, or train position may be requested to be entered by the operator via the HMI user interface for further correlation and/or verification.

The PTCC module may also provide information and calls to action (e.g., messages, warnings, suggested actions, commands) to a conductor via the HMI user interface. Using control algorithms, the PTCC may bypass the conductor and actuate a change in train behavior (e.g., function, operation) utilizing the integration with the braking interface or the traction interface to adjust the speed of the train. PTCC handles the routing of information by describing the recipient(s) of interest, the payload, frequency, route and duration of the data stream to share the train state with third party listeners and devices.

The PTCC may also dispatch/receive packets of information automatically or through calls to action from the common backend server in the control room or from the railway operators or from the control room terminal or from the conductor or from wayside signaling or modules in the PTC vision system or other third party listeners subscribed to the data on the train.

The PTCC may also receive information concerning assets near the location of the moving vehicle. The PTCC may use the VA to collect data concerning PTC and other assets. The PTCC may also process the newly collected data (or forward it) to audit and augment the information in the backend database.

Figure 6:
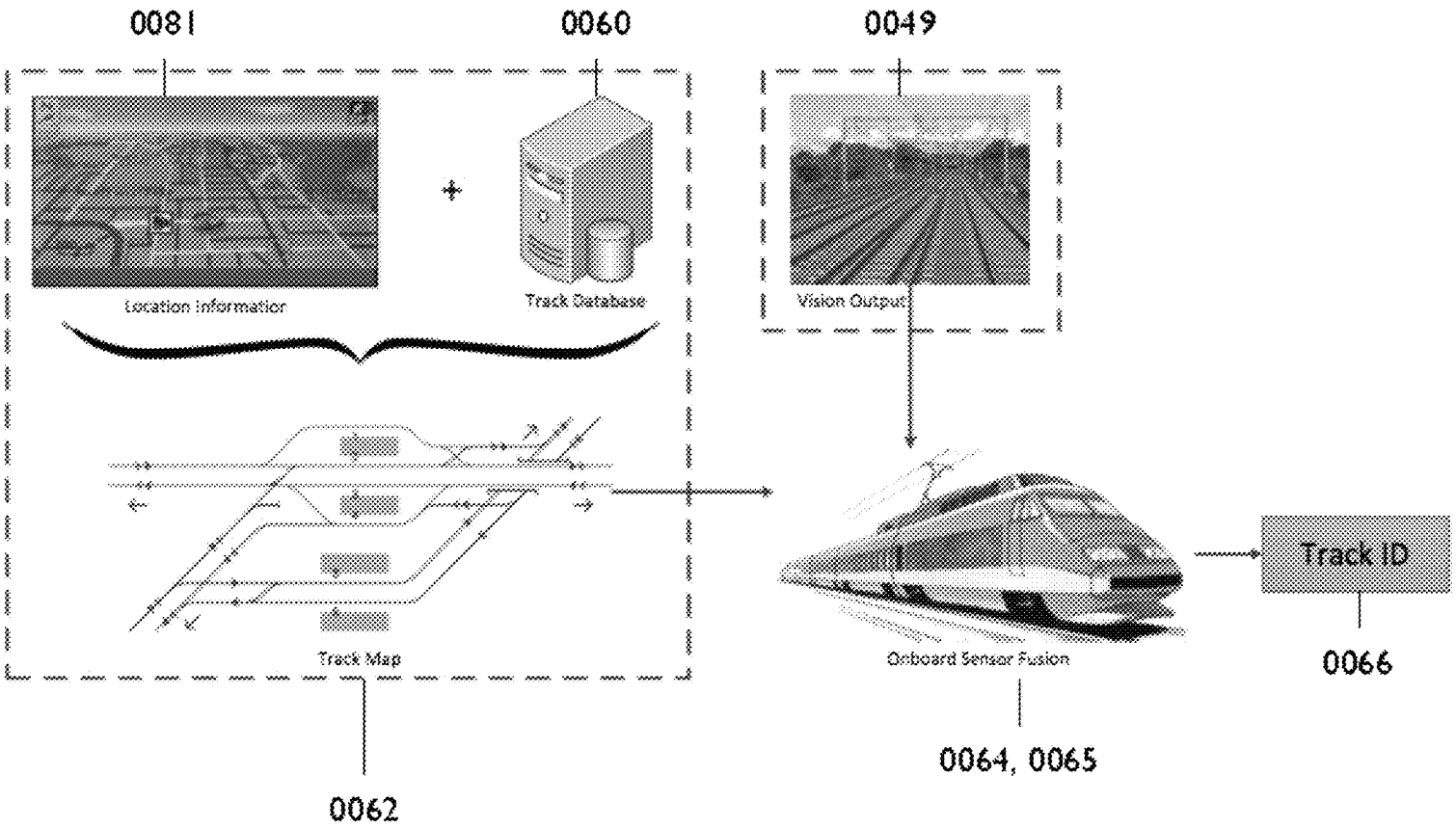
FIG. 6 is a representative flow diagram for obtaining the track ID occupied by the train.
Figure 7:
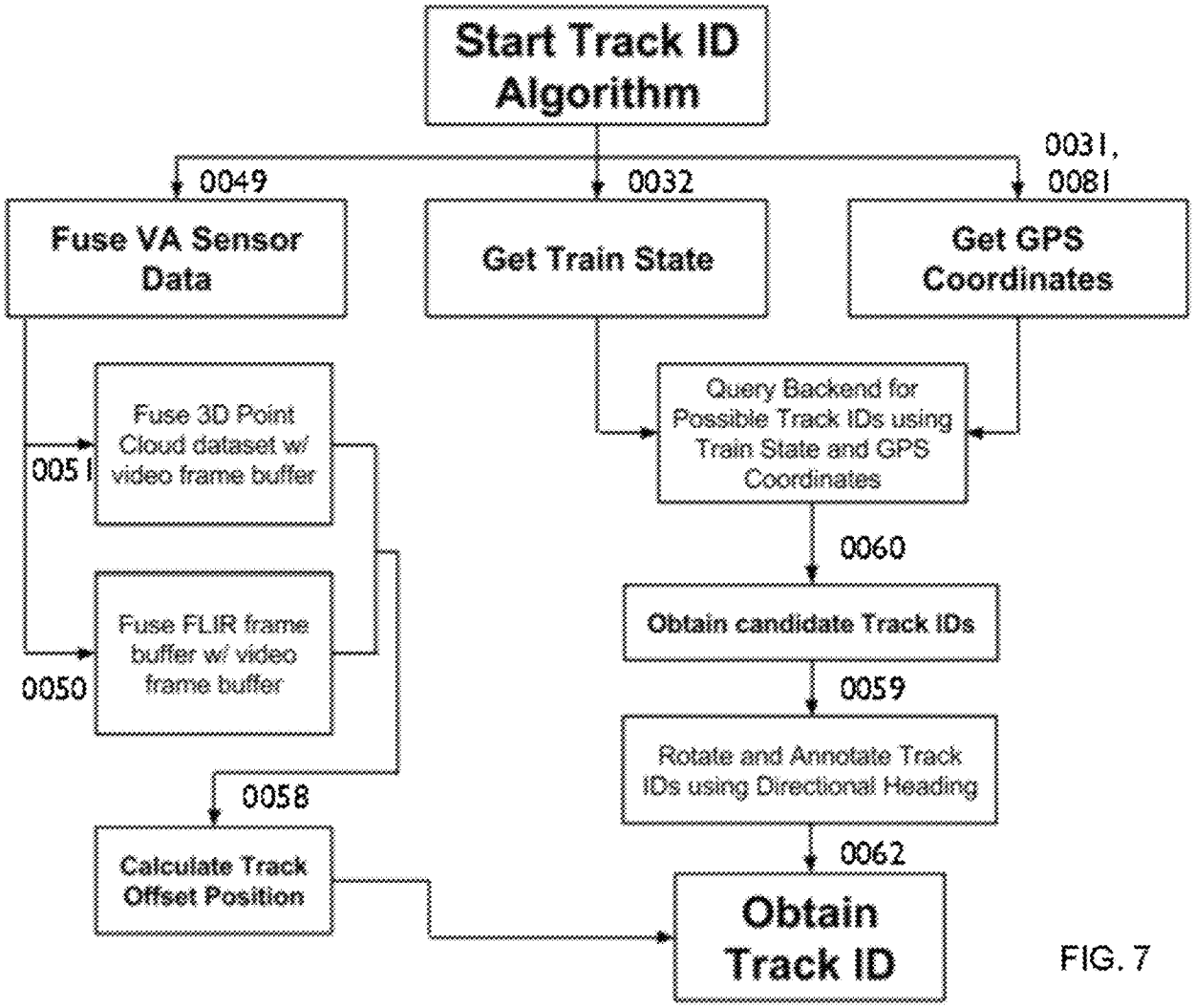
FIG. 7 is a representative flow diagram which describes the track ID algorithm.

Algorithms: The Track Identification Algorithm (TIA), depicted in FIGS. 6-7 determines which track the rolling stock is currently utilizing. The TIA creates a superimposed feature dataset by overlaying the features from the 3D LIDAR scanners and FLIR Cameras onto the onboard camera frame buffer. The superset of features (global feature vector) allows for three orthogonal measurements and perspectives of the tracks.

Thermal features from the FLIR Camera may be used to identify (e.g., separate, locate, isolate) the thermal signature of the railway tracks to generate a region of interest (spatial & temporal filters) in the global feature vector.

Range information from the 3D LIDAR scanner's 3D point cloud dataset may be utilized to identify the elevation of the railway track to also generate a region of interest (spatial & temporal filters) in the global feature vector.

Line detection algorithms may be utilized on the onboard camera, FLIR cameras and 3D LIDAR scanner's 3D point cloud dataset to further increase confidence in identifying tracks.

Color information from the onboard camera and the FLIR cameras may be used to also create a region of interest (spatial & temporal filter) in the global feature vector.

The TIA may look for overlaps in the regions of interest from multiple orthogonal measurements on the global feature vector to increase redundancy and confidence in track identification data.

The TIA may utilize the region of interest data to filter out false positives when the regions of interest do not overlap in the global feature vector.

The TIA may process the feature vectors in a region of interest to identify the width, distance, and curvature of a track.

The TIA may examine the rate at which a railway track is converging towards a point to further validate the track identification process; furthermore the slope of a railway track may also be used to filter out noise in the global feature vector dataset.

The TIA may take into consideration the spatial and temporal consistency of feature vectors prior to identifying the relative offset position of a train amongst multiple railway tracks.

Directional heading may be obtained by sampling the GPS receiver multiple times to create a temporal profile of movement in geographic coordinates.

The list of potential absolute track IDs may be obtained through a query to a locally cached GIS dataset or a remotely hosted backend server.

In a situation wherein the GPS receiver loses synchronization with GPS satellites, the odometer and directional heading may be used to calculate the dead reckoning offset.

The TIA compares the relative offset position of the train among multiple railway tracks and references to the list of potential absolute track IDs to identify the absolute track ID that the train is utilizing.

After the TIA obtains an absolute track ID, the global feature vector samples may be annotated with the geolocation (e.g., geographic coordinate) information and track ID. This allows the TIA to utilize the global feature vector datasets to directly determine a track position in the future. This machine learning approach reduces the computational cost of searching for an absolute track ID.

The TIA may further match global feature vector samples from a local or backend database with spatial transforms. The parameters of the spatial transform may be utilized to calculate an offset position from a reference position generated from the query match.

Furthermore, the TIA may utilize the global feature vectors to stitch together features from multiple points in space or from a single point in space using various image processing techniques (e.g., image stitching, geometric registration, image calibration, image blending). This results in a superset of feature data that has collated global feature vectors from multiple points or a single point in space.

Figure 10:
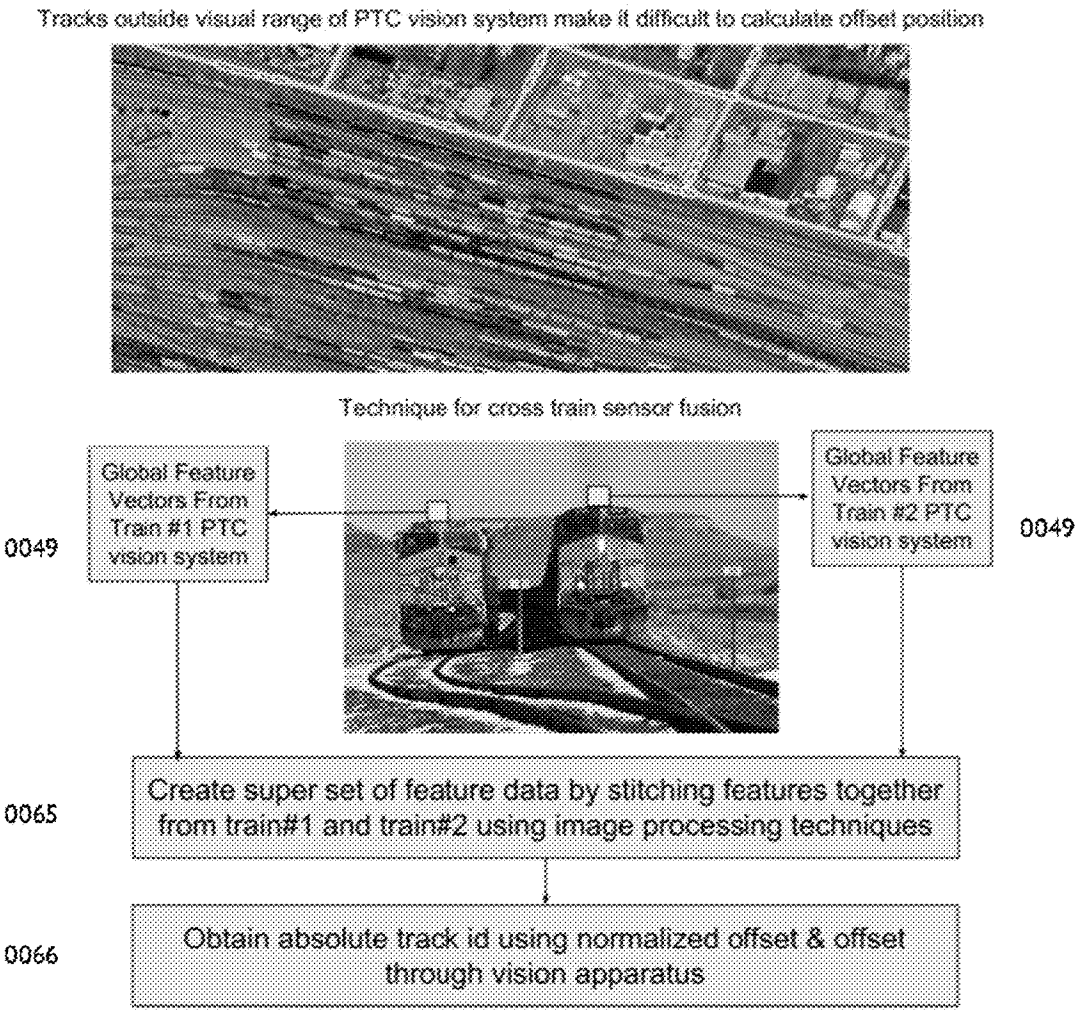
FIG. 10 is a representative flow diagram of image stitching techniques for relative track positioning.

Utilizing the superset of data, the TIA can normalize the offset position for a relative track ID prior to determining an absolute track ID. This is useful when there are tracks outside the range of the vision apparatus (VA). This functionality is depicted in FIG. 10.

The TIA is a core component in the PTC vision system that eliminates the need for wireless transponders, beacons or balises to obtain positional data. TIA may also enable railway operators to annotate newly constructed railway tracks for their network wide GIS datasets that are authoritative in mapping the wayside equipment and infrastructure assets.

Figure 4:
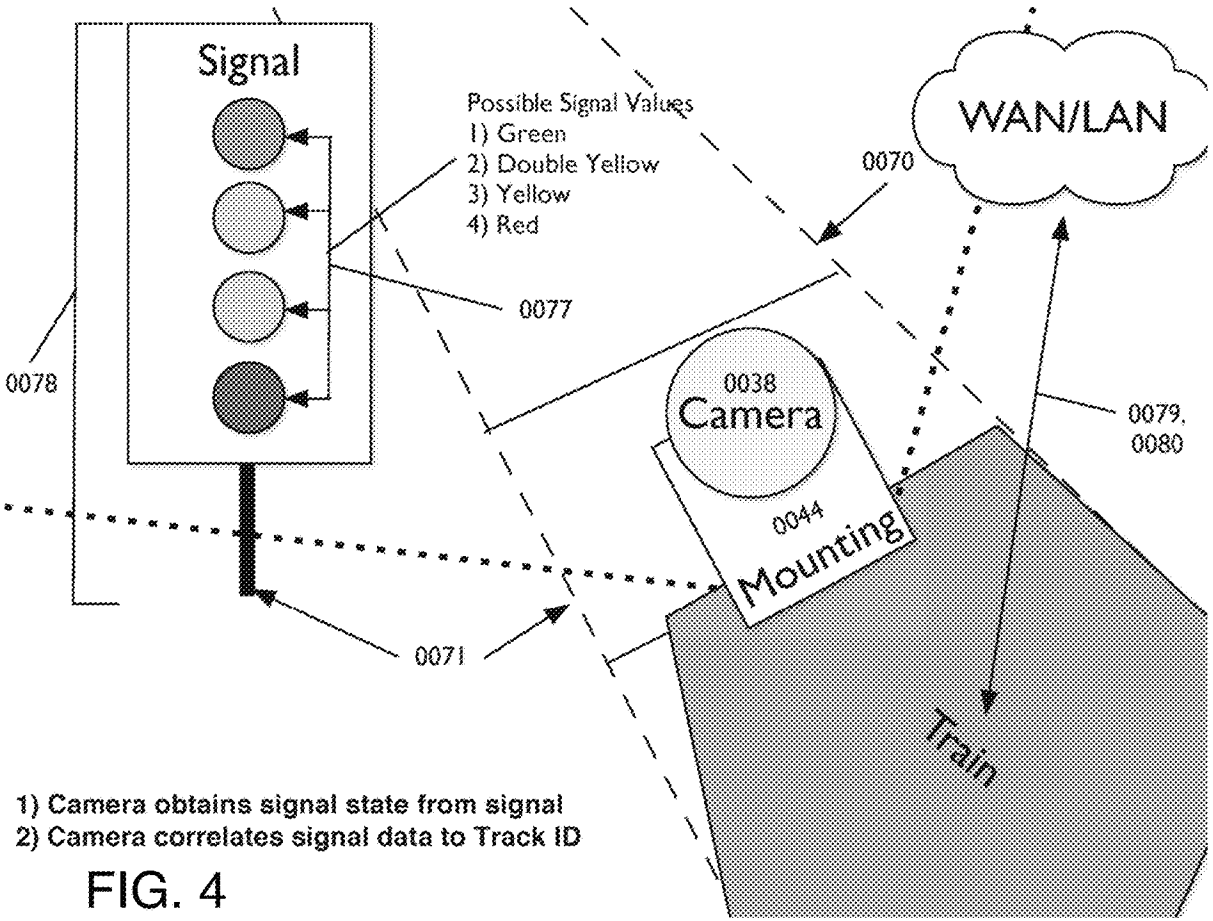
FIG. 4 is an exemplary depiction of a train extrapolating the signal state.
Figure 8:
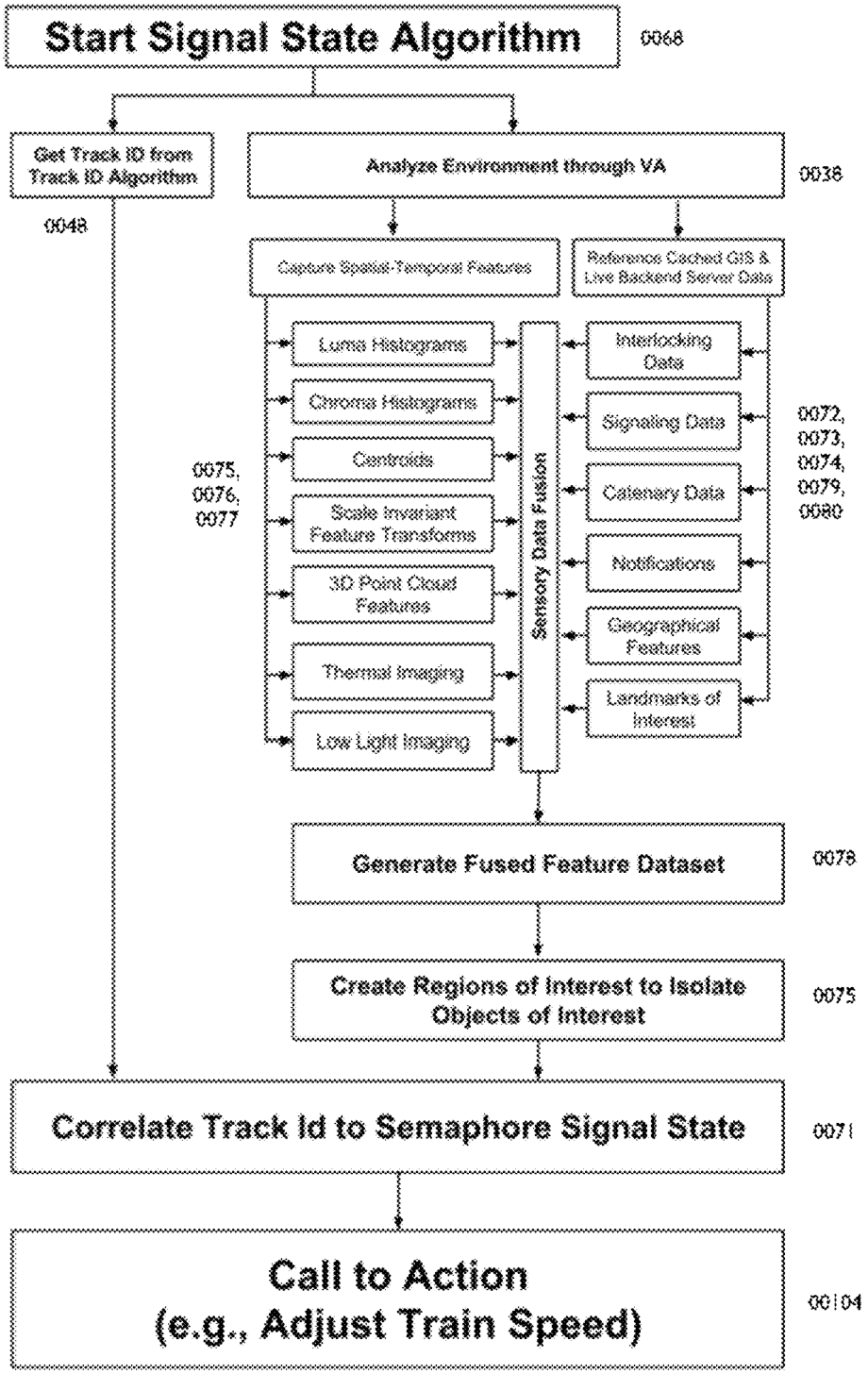
FIG. 8 is a representative flow diagram which describes the signal state algorithm.

The Signal State Algorithm (SSA), described in FIG. 8, determines the signal state of the track a train is currently utilizing. The purpose of this component is to ensure a train's operation is in compliance with the expected operational parameters of the railway operators or modal control rooms or central control rooms. The compliance of a train's inertial metrics along a railway track can be audited in a distributed environment many backend servers or a centralized environment with a common backend server. A train's ability to obtain the absolute track ID is important for correlating the semaphore signal state to the track ID utilized by a train. Auditing signal compliance is possible once the correlation between the semaphore signal state and the absolute track ID is established. Placement of sensors is important for efficiently determining a semaphore signal state. FIG. 4 depicts one example wherein the 3D LIDAR scanner is forward facing and mounted on top of a train's roof.

The SSA takes into account an absolute track ID utilized by a train in order to audit the signal compliance of the train. Once the correlation of a track to a semaphore signal is complete, the signal state from that semaphore signal may actuate calls to action as feedback to a train or conductor.

Correlation of a railway track to a semaphore signal state may be possible by analyzing the regulatory specifications for wayside signaling from a railway operator. Utilizing the regulatory documentation, the spatial-temporal consistency of a semaphore signal may be compared to the spatial-temporal consistency of a railway track. A scoring mechanism may be used to choose the best candidate semaphore signal for the current railway track utilized by the train.

A local or remote GIS dataset may be queried to confirm the geolocation of a semaphore signal.

A local or remote signaling server may be queried to confirm the signal state in the semaphore signal matches what the PTC vision system is extrapolating.

Areas wherein the signal state is available to the train via radio communication may be utilized to confirm the accuracy of the PTC vision system and additionally augment the feedback provided to a machine learning apparatus that helps tune the PTC vision system.

A 3D point cloud dataset obtained from a PTC vision system may be utilized to analyze the structure of the semaphore signal. If the structure of an object of interest matches the expected specifications as defined by the regulatory body for a semaphore signal in that rail corridor, the object of interest may be annotated and added as a candidate for the scoring mechanism referenced above.

An infrared image captured through an FLIR camera may be utilized to identify the light being emitted from a wayside semaphore signal. In a situation where the red light is emitting from a candidate semaphore signal that is correlated to a track the train is currently on, a call to action will be dispatched to the HMI onboard the train for signal compliance. Upon a train's failure to comply with a semaphore signal that is correlated to a track the train is currently on, a call to action will be dispatched directly to the braking interface onboard the train for signal compliance.

The color spectrum in an image captured through the PTC vision system may be segmented to compute centroids that are utilized to identify blobs that resemble signal green, red, yellow or double yellow lights. A centroid's spatial coordinates and size of its blob may be utilized to validate the spatial-temporal consistency of the semaphore signal with specifications from a regulatory body.

A spatial-temporal consistency profile of a track may be created by analyzing the curvature of a track, spacing between the rails on a track, and rate of convergence of the track spacing towards a point on the horizon. A spatial-temporal consistency profile of a semaphore signal may be created by analyzing the following components: the height of a semaphore signal, the relative spatial distance between points in space, and the orientation and distance with respect to a track a train is currently utilizing.

The backend server may be queried to inform a train of an expected semaphore signal state along a railway track segment that the train is currently utilizing.

The backend server may be queried to inform a train of an expected semaphore signal state along a railway track segment identified by an absolute track ID and geolocation coordinates.

Figure 3:
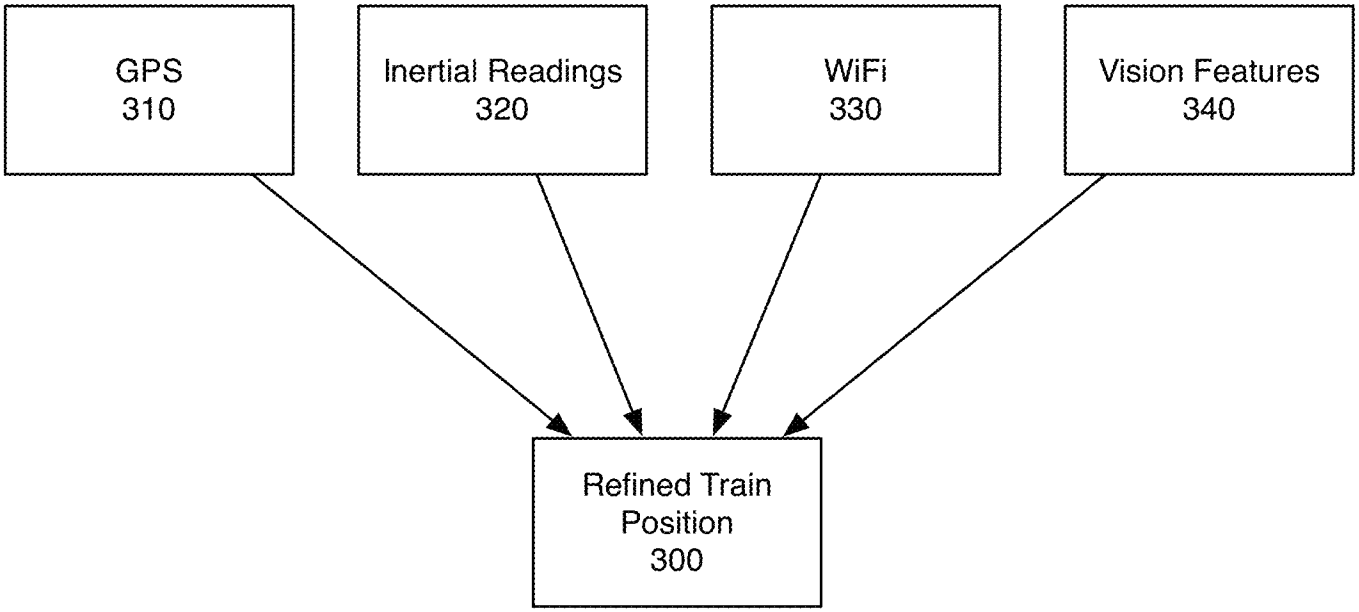
FIG. 3 is a representative flow diagram for obtaining positional information.

The Position Refinement Algorithm, as depicted in FIG. 3, provides a high confidence geolocation service onboard the train. The purpose of this algorithm is to ensure that loss of geolocation services does not occur when a single sensor fails. The PRA relies on redundant geolocation services to obtain the track position.

GPS or Differential GPS may be utilized to obtain fairly accurate geolocation coordinates.

Tachometer data along with directional heading information can be utilized to calculate an offset position.

A WiFi antenna may scan SSIDs along with signal strength of each SSID while GPS is working and later use the Medium Access Control (MAC) addresses (or any unique identifier associated with an SSID) to quickly determine the geolocation coordinates. The signal strength of the SSID during the scan by a WiFi antenna may be utilized to calculate the position relative to the original point of measurement. The PTC vision system may choose to insert the SSID profile (SSID name, MAC address, geolocation coordinates, signal strength) as a reference point into a database based on the confidence in the current train's geolocation.

Global feature vectors created by the PTC vision system may be utilized to lookup geolocation coordinates to further ensure accuracy of the geolocation coordinates.

A scoring mechanism that takes samples from all the components described above would filter out for inconsistent samples that might inhibit a train's ability to obtain geolocation information. Furthermore, the samples may carry different weightage based on the performance and accuracy of each subcomponent in the PRA.

PTC Vision System High Level Process Description

Figure 9:
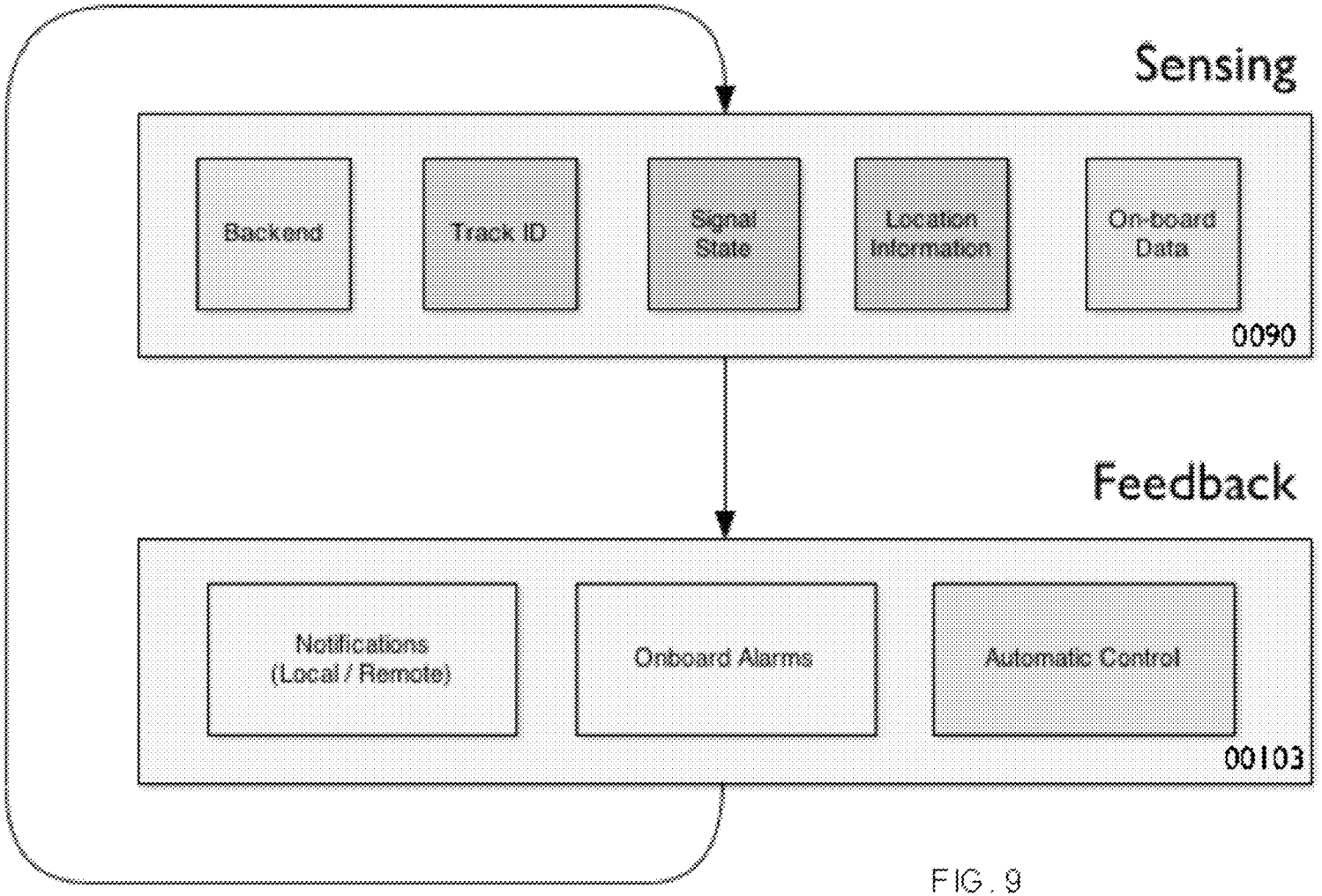
FIG. 9 is a representative flow diagram which depicts sensing and feedback.

In this section, we refer to the flowchart shown in FIG. 9. The PTC vision system samples the train state from the various subsystems described above. The train state is defined as a comprehensive overview of track, signal and on-board information. In particular the state consists of track ID, signal state of relevant signals, relevant on-board information, location information (pre- and post-refinement, reference PRA, TIA and SSA algorithms described above), and information obtained from backend servers. These backend servers hold information pertaining to the railroad infrastructure. A backend database of assets is accessed remotely by the moving vehicle as well as railroad operators and officers. The moving train and its conductor for example use this information to anticipate signals along the route. Operator and maintenance officers have access to track information for example. These reports and notifications are relevant to signals and signs, structures, track features and assets, safety information.

After collecting this state, the PTC vision system issues notifications (local or remote), possibly raises alarms onboard the train, and can automatically control the train's inertial metrics by interfacing with various subsystems onboard (e.g., traction interface, braking interface, traction slippage system).

Sensory Stage

On-board data: The On-board data component represents a unit where all the data extracted from the various train systems is collected and made available. This data usually includes but is not limited to: Time information, Diagnostics information from various onboard devices, Energy monitoring information, Brake interface information, Location information, Signaling state obtained from train interfaces to wayside equipment, Environmental state obtained through the VA devices on board or on other trains, and Any other data from components that would help in Positive Train Control.

This data is made available within the PTC vision system for other components and can be transmitted to remote servers, other trains, or wayside equipment.

Location data is strategic to ensure that trains are operating within a safety envelope that meets the Federal Railroad Administration's PTC criteria. In this regard, wayside equipment is currently being utilized by the industry to accurately determine vehicle position. The output of location services described above (e.g., TIA & SSA) provides the relative track position based on computer vision algorithms.

The relative position can be obtained through using a single sensor or multiple sensors. The position we obtain is returned as an offset position, usually denoted as a relative track number. Directional heading can also be a factor in building a query to obtain the absolute position from the feedback to the train.

The absolute position can be obtained either from a cached local database, or cached local dataset, remote database, remote dataset, relative offset position using on board inertial metric data, GPS samples, Wi-Fi SSIDs and their respective signal strength or through synchronization with existing wayside signaling equipment.

The various types of datasets we use include but are not limited to: 3D point cloud datasets, FLIR imaging, Video buffer data from on-board cameras.

Once the location is known, this information can be utilized to correlate signal state from wayside signaling to the corresponding track. The location services can also be exposed to third party listeners. The on board components defined in the PTC vision system can act as listeners to the location services. In addition, the train can scan the MAC IDs of the networked devices in the surrounding areas and utilize MAC ID filtering for any application these networked devices are utilizing. This is useful for creating context aware applications that depend on the pairing the MAC ID of a third party device (e.g., mobile phones, laptops, tablets, station servers, and other computational devices) with a train's geolocation information.

The track signal state is important for ensuring the train complies with the PTC safety envelope at all times. The PTC vision system's functional scope includes extrapolating the signal value from wayside signaling (semaphore signal state). In this regard, the communication module or the vision apparatus may identify the signal values of the wayside equipment. In areas where the signal is not visible, a central back end server can relay the information to the train as feedback. When wayside equipment is equipped with radio communication, this information can also augment the vision-based signal extrapolation algorithms (e.g., TIA & SSA). Datasets are used at the discretion of the PTC vision system.

Utilizing datasets collected by the PTC vision system, one can identify the features of the track from the rest of the data in the apparatus and identify the relative track position. The relative track position along with directional heading information can be sent to a backend server to obtain the absolute track ID. The absolute track ID denotes the track identification as listed by the operator. This payload is arbitrary to the train, allowing seamless operations amongst multiple operators without having an operator specific software stack on the train. Operator agnostic software allows trains to operate with great interoperability, even if it is traveling through infrastructures from different rail operators. Since the payloads are arbitrary, the trains are intrinsically interoperable even when switching between rail-operators. As the rolling stock travels along the track, data necessary for updating asset information is generated by the vision apparatus. This data then gets processed to verify the integrity of certain asset information, as well as update other asset information. Missing assets, damaged assets or ones that have been tampered with can then be detected and reported. The status of the infrastructure can also be verified, and the operational safety can be assessed, every time a vehicle with the vision apparatus travels down the track. For example, clearance measurements are performed making sure that no obstacles block the path of trains. The volume of ballast supporting the track is estimated and monitored over time.

Backend:

The backend component has many purposes. For one, it receives, annotates, stores and forwards the data from the trains and algorithms to the various local or remote subscribers. The backend also hosts many processes for analyzing the data (in real-time or offline), then generating the correct output. This output is then sent directly to the train as feedback, or relayed to command and dispatch centers or train stations.

Some of the aforementioned processes can include: Algorithms to reduce headways between trains to optimize the flow on certain corridors; Algorithms that optimize the overall flow of the network by considering individual trains or corridors; and Collision avoidance algorithms that constantly monitor the location and behavior of the trains.

The backend also hosts the asset database queried by the moving train to obtain asset and infrastructure information, as required by rolling stock movement regulations. This database holds the following assets with relevant information and features: PTC assets, ETCS assets, Tracks, Signals, Signal lights, Permanent speed restrictions, Catenary structures, Catenary wires, Speed limit Signs, Roadside safety structures, Crossings, Pavements at crossings, Clearance point locations for switches installed on the main and siding tracks, Clearance/structure gauge/kinematic envelope, Beginning and ending limits of track detection circuits in non-signaled territory, Sheds, Stations, Tunnels, Bridges, Turnouts, Cants, Curves, Switches, Ties, Ballast, Culverts, Drainage structures, Vegetation ingress, Frog (crossing point of two rails), Highway grade crossings, Integer mileposts, Interchanges, Interlocking/control point locations, Maintenance facilities, Milepost signs, and Other signs and signals.

The rolling stock vehicle utilizes the information queried from the database to refine the track identification algorithm, the position refinement algorithm and the signal state detection algorithm. The train (or any other vehicle utilizing the machine vision apparatus) moving along/in close proximity to the track collects data necessary to populate, verify and update the information in the database. The backend infrastructure also generates alerts and reports concerning the state of the assets for various railroad officers.

FEEDBACK STAGE

Figure 5:
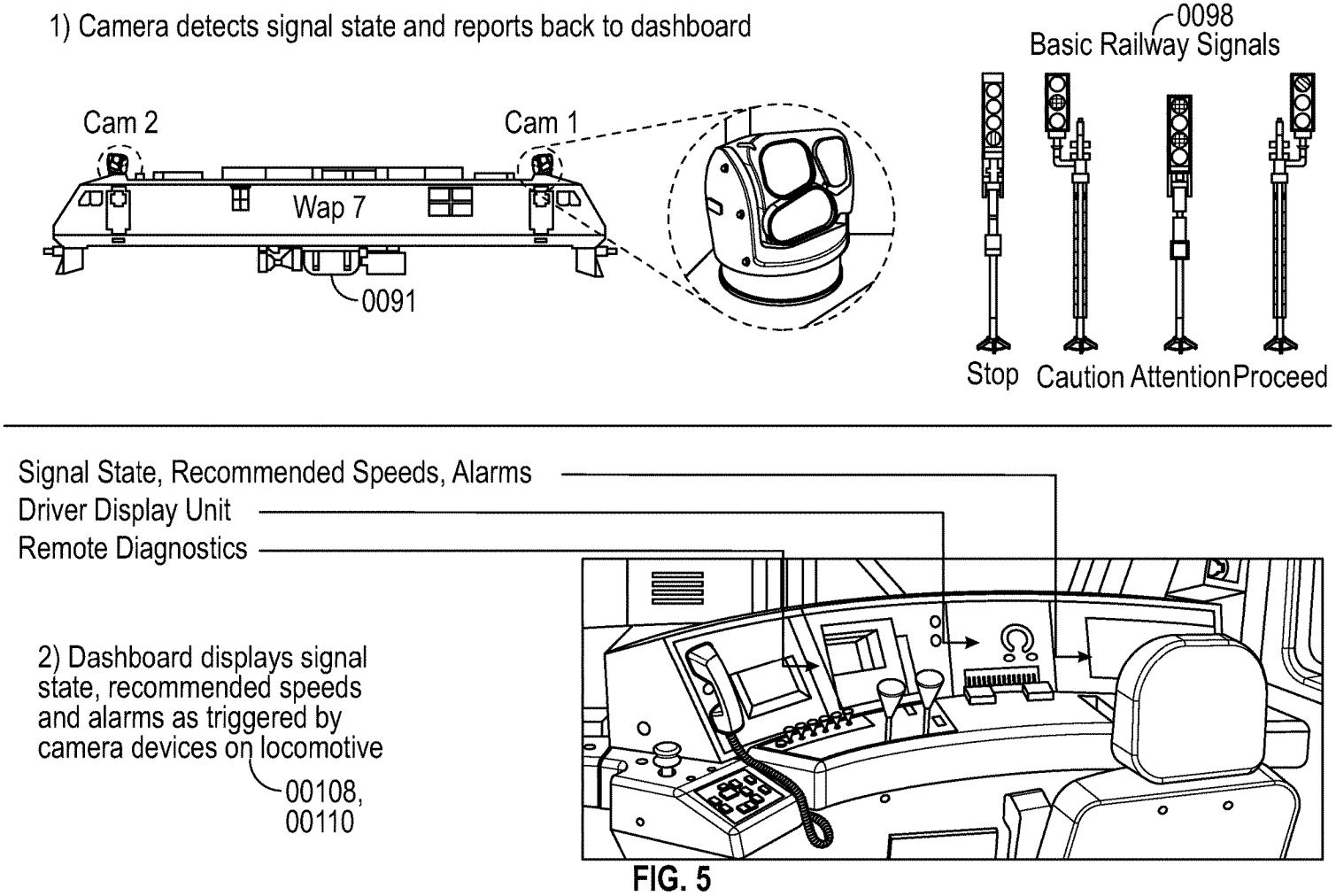
FIG. 5 is an exemplary depiction of the various interfaces available to the conductor as feedback.

Automatic Control:

There are several ways with which the train can be controlled using the PTC vision system (e.g., Applications in FIG. 5). The output of the sensory stage might trigger certain actions independently of the any other system. For example, upon the detection of a red-light violation, the braking interface might be triggered automatically to attempt to bring the train to a stop.

Certain control commands can also arrive to the train through its VCD. As such, the backend system can for example instruct the train to increase its speed thereby reducing the headway between trains. Other train subsystems might also be actuated through the PTC vision system, as long as they are accessible on the locomotive itself.

Onboard Alarms:

Feedback can also reach the locomotive and conductor through alarms. In the case of a red-light violation for example, an alarm can be displayed on the HMI. The alarms can accompany any automatic control or exist on its own. The alarms can stop by being acknowledged or halt independently.

Notifications (Local/Remote):

Feedback can be in the form of notifications to the conductor through the user interface of the HMI module. These notifications may describe the data sensed and collected locally through the PTC vision system, or data obtained from the backend systems through the VCD. These notifications may require listeners or may be permanently enabled. An example of a notification can be about speed recommendations for the conductor to follow.

Backend Architecture and Data Processing.

The backend may have two modules: data aggregation and data processing. Data aggregation is one module whose role is to aggregate and route information between trains and a central backend. The data processing component is utilized to make recommendations to the trains. The communication is bidirectional and this backend server can serve all of the various possible applications from the PTC vision system.

Possible applications for PTC vision system include the following: Signal detection; Track detection; Speed synchronization; Extrapolating interlocking state of track and relaying it back to other trains in the network; Fuel optimization; Anti-Collision system; Rail detection algorithms; Track fault detection or preventative derailment detection; Track performance metric; Image stitching algorithms to create comprehensive reference datasets using samples from multiple runs; Cross Train imaging for, e.g., Preventative maintenance, Fault detection, and/or Vibration signature of passerby trains; Imaging based geolocation or geofiltering services; SSID based geolocation or geofiltering; and Sensory fusion of GPS+Inertial Metrics+Computer Vision-based algorithms.

Figure 25:
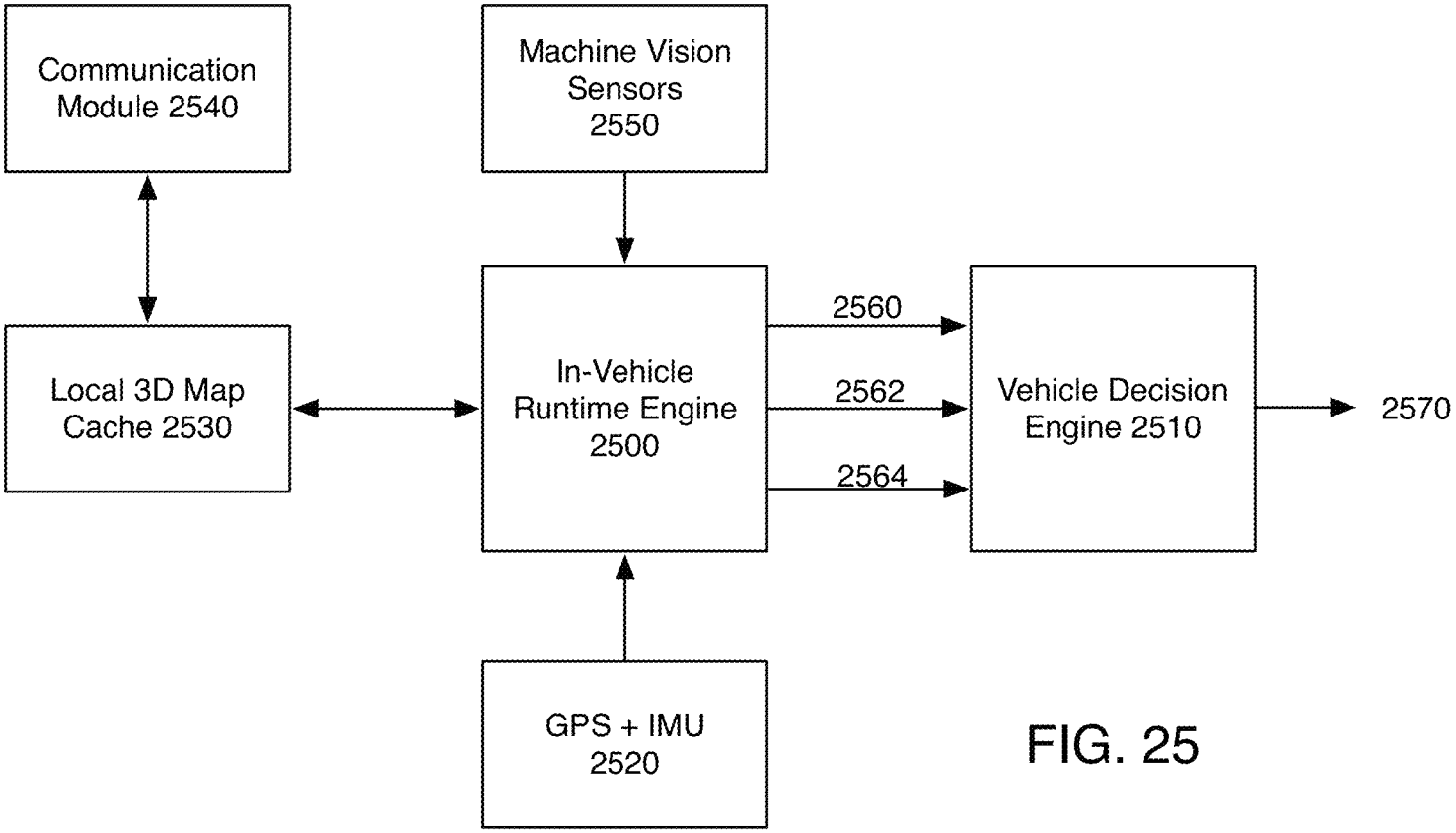
FIG. 25 is a schematic block diagram of a run-time system for automobile localization, automobile control and map auditing.

In accordance with other embodiments, remote sensing and localization features can be utilized to implement runtime systems in automotive vehicles, such as autonomously driving cars. FIG. 25 is a schematic block diagram of an exemplary in-vehicle system for vehicle localization and/or control. In-vehicle runtime engine ("IVRE") 2500 and vehicle decision engine 2510 are computation and control modules, typically microprocessor-based, implemented locally on board a vehicle. Local 3D map cache 2530 stores map data associated with the area surrounding the vehicle's rough position, as determined by GPS and IMU sensors 2520, and can be periodically or continuously updated from a remote map store via communications module 2540 (which may include, e.g., a cellular data transceiver). Machine vision sensors 2550 may include one or more mechanisms for sensing a local environment proximate the vehicle, such as LiDAR, video cameras and/or radar.

In operation, IVRE 2500 implements vehicle localization by obtaining a rough vehicle position from onboard GPS and IMU sensors 2520. Machine vision sensors 2550 generate environmental signatures indicative of the local environment surrounding the vehicle, which are passed to IVRE 2500. IVRE 2500 queries local 3D map cache 2530 using environmental signatures received from machine vision sensors 2550, to match features or objects observed in the vehicle's local environment to known features or objects having known positions within 3D semantic maps stored in cache 2530. By comparing the vehicle's observed position relative to local features or objects, with the position of those features and objects on maps, the vehicle's position can be refined with significantly more accuracy than typically possible using GPS—with margin of error potentially measured in centimeters.

Detailed vehicle position and other observed or calculated information can be utilized to implement other functionality, such as vehicle control and/or map auditing. For example, data from machine vision sensors 2550 can be analyzed using graphs and other data analysis mechanisms, as described elsewhere herein, for IVRE 2500 to determine a centerline for a lane in which the vehicle is traveling. IVRE 2500 can also operate to obtain semantics (such as events and triggers) along the vehicle's route. Available compute resources can be used to audit centralized map data sources by comparing previously-observed asset information obtained from centralized maps (and, e.g., stored in local 3D map cache 2530) to asset information derived from real time data captured by machine vision sensors 2550. IVRE 2500 can thereby identify errors of omission (i.e. observed assets omitted from centralized map data) as well as errors of commission (i.e. assets in centralized map data that are not observed by machine vision sensors 2550). Such errors can be stored in cache 2530, and subsequently communicated to a central map repository via communications module 2540.

In some embodiments, auditing of map data by a local vehicle may be initiated by a centralized control server, communicating with the vehicle via communications module 2540. For example, if the time elapsed since last auditing of a map section exceeds a threshold, a centralized control server can request auditing from a local vehicle traveling through the target region. In another example, if one vehicle reports discrepancies between centralized map data and locally-observed conditions, the centralized control server may request confirmation auditing by one or more other vehicles moving within the area of the discrepancy. Auditing requests may pertain to various combinations of geographic regions and/or mapping layers.

In some embodiments, it may be desirable to utilize information such as precise vehicle position, assets and semantics, and navigation information, as inputs to vehicle decision engine 2510. Vehicle decision engine 2510 can operate to control various other systems and functions of the vehicle. For example, in an autonomous driving implementation, vehicle decision engine 2510 may utilize lane center line information and precise vehicle position information in order to steer the vehicle and maintain a centered lane position. These and other vehicle control operations may be beneficially implemented using systems and processes described herein.

Semantic Map Creation Using Geospatial Data

Maps are collections of objects, their location and their properties. Maps can be divided into layers, where each layer is a grouping of objects of the same type. The location of each object is defined, along with a geometric attribute (example: the location of a pole could be a point in three-dimensional space, whereas a signal can be located by drawing a polygon around it). A map becomes "semantic" when the semantic associations between different objects and layers are also recorded. For example, a map composed of the centerlines of various lanes on a roadway as well as the signs located around the infrastructure is labeled semantic, when the associations between the various signs and centerlines are recorded. This can be achieved by creating a mapping between the unique identifier of a sign and the unique identifiers of the lanes to which the sign is relevant. The semanticization of a map creates more context for the vehicle or user consuming the map. The semantic map can also be packaged with regulatory information from various transportation authorities.

Any asset's physical geometry can be described in a map. Geometric features used to describe shapes include points, lines, polygons, and arcs. The features are typically in three dimensions, but they can be projected into two-dimensional spaces where depth/elevation is lost. In general, semantic maps can be recorded and delivered in different coordinate and reference frames. There are also transformations allowing to project maps from one coordinate reference frame to the next. These maps can be packaged and delivered in different formats. Common formats include GeoJSON, KML, shapefiles, and the like.

In some embodiments, the geospatial data used for semantic map creation comes from LiDAR, visible spectrum cameras, infrared cameras, and other optical equipment. The act of obtaining machine vision data for map creation, where this data is georeferenced to a particular location on the planet, is called surveying. The output is a set of data points in three dimensions, along with images and video feeds in the visible spectrum and other frequencies. There can be many different hardware platforms for data collection. The collection vehicle is also variable (aerial, mobile, terrestrial). The geospatial data is collected initially with the collection vehicle being the origin of the reference frame. By locating the vehicle throughout the survey (using, e.g., an Inertial Measurement Unit (IMU) and Global Positioning Systems (GPS)), the images, laser scans and video feeds are then registered to a fixed reference frame which which is georeferenced. The data generated in the survey can be streamed or saved locally for later consumption.

Some embodiments of the vehicle localization and local environment sensing systems described herein benefit from use of point cloud survey data. Semantic maps derived from point cloud survey data may provide a vehicle with high levels of detail and information regarding the vehicle's current or anticipated local environment, which may be used, for example, to assist in relative vehicle localization, or serve as input data to autonomous control decision-making systems (e.g. automated braking, steering, speed control, etc.). Additionally, or alternatively, point-cloud data measured by a vehicle may be compared to previously-measured point cloud data to detect conditions or changes in a local environment, such as a fallen tree, overgrown vegetation, changed signage, lane closures, track or roadway obstructions, or the like. The detected changes in the environment can be used to further update the semantic maps.

However, increasing levels of point cloud survey data detail can result in extremely large datasets, which may be costly or time consuming for a service provider to process, or for a vehicle to store or process. For example, LiDAR-based 3D railroad surveying systems traveling linearly along a rail track may generate over 20 GB of geospatial data for every kilometer of scanning. The raw point cloud data generated by LiDAR scanning typically then requires additional processing to extract useful asset information.

Figure 11A:
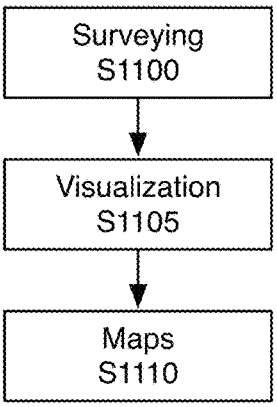
FIG. 11A PRIOR ART
FIGS. 11A and 11B are flow diagrams of point-cloud analysis processes.

Three dimensional semantic maps are traditionally created from point cloud data and other geospatial data through the use of 3D visualization software. FIG. 11A illustrates a typical prior art process for extracting asset information from point cloud data. In step S1100, surveying procedures generate point cloud data sets, such as using a LiDAR surveying apparatus. In step S1105, the raw point cloud data is visualized. Typically, Geographical Information Systems (GIS) analysts use point-and-click methods to manually identify, annotate, and classify critical assets within the data. The first step in the GIS analysts' process is to separate the terabytes of point cloud data into smaller manageable sections. This is due to the fact that contemporary personal computers are limited (memory/computational power) and are unable to manage the terabytes of LiDAR data at once.

Subsequently, the GIS analysts use 3D visualization software to traverse each of the smaller sections of point cloud. As they progress through their respective sections, the GIS analysts delineate and annotate the important assets. Finally, the annotated assets of each GIS analyst are combined into one map (step S1110). Varying file formats and software systems can create additional difficulties in merging the separate datasets.

Extracting value from point-cloud data is limited by both the prior art process and the infrastructure. Point-and-click annotation is manual, slow and prone to error. Additionally, conventional file-based systems prevent GIS developers and administrators from effectively managing the growing point cloud datasets.

Figure 11B:
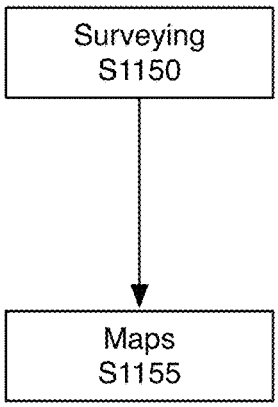

FIG. 11B illustrates an alternative approach to extracting asset information from raw point cloud data. In step S1150, surveying is conducted to generate the raw point cloud data. In step S1155, asset maps are generated directly from the raw point cloud data, without requiring visualization of the large, complex data set, or manual annotation of that data.

Figure 12:
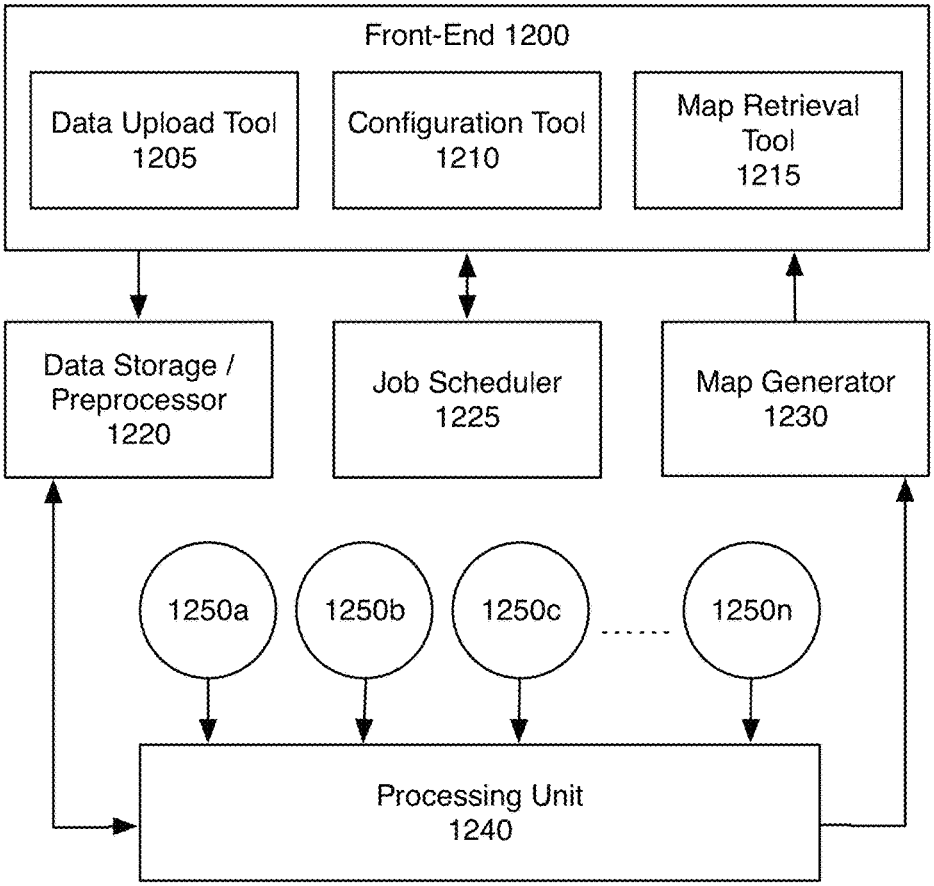
FIG. 12 is a schematic block diagram of an apparatus for point-cloud analysis.
Figure 13:
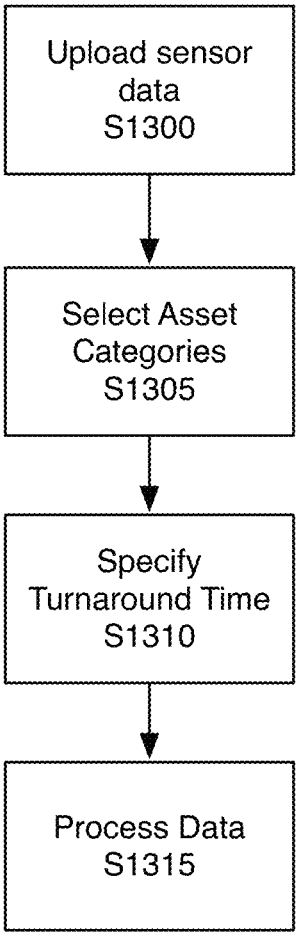
FIG. 13 is a flow diagram of a process for analyzing point-cloud data.

FIG. 12 illustrates a computing apparatus for rapidly and efficiently extracting asset information from large point-cloud data sets. FIG. 13 illustrates a process for using the apparatus of FIG. 12. Preferably, the components within the apparatus of FIG. 12 are implemented using Internet-connected cloud computing resources, which may include one or more servers. Front-End component 1200 includes data upload tool 1205, configuration tool 1210, and map retrieval tool 1215. Front-End component 1200 provides a mechanism for end users to interact with and control the computing apparatus.

Using data upload tool 1205, a user can upload LiDAR and other surveying data from a local data storage device to data storage component 1220 (step S1300). Data storage component 1220 may implement a distributed file system (such as the Hadoop Distributed File System) or other mechanism for storing data. Configuration tool 1210 can be accessed via a user's network-connected computing device (not shown), and enables a user to define the format of uploaded data as well as other survey details, and specify assets to search for and annotate (step S1305). After a user interacts with configuration tool 1210 to select desired assets, the user is provided with various options to configure the output map format. Preferably, configuration tool 1210 then solicits a desired turnaround time from a configuring user, and presents the user with an estimated cost for the analysis (step S1310). The cost estimate is determined based on, e.g., the size of the uploaded data set to be analyzed, the number (and complexity) of selected assets, the output format, and the selected turnaround time. Finally, when configuration is complete, the user interacts with configuration tool 1210 to initiate an analysis job (step S1315).

The geospatial data uploaded through front end 1200 is tracked in database collections. This data is organized by category, geographic area, and other properties. As the data evolves through various stages of execution, the relevant database entries get updated.

Point-cloud data uploaded through the front-end tool is stored in a secure and replicated manner. To simplify retrieval, the data is tiled into different size tiles in a Cartesian coordinate system. The tiles themselves are limited in two dimensions and namespaced accordingly. Preferably, tiles are limited in X and Y dimensions, and unlimited in a Z dimension that is vertical or parallel to the direction of the Earth's gravitational pull, such that a tile defines a columnar area, unlimited in height (i.e. limited only to the extent of available geospatial data) and having a rectangular cross-section. In an exemplary implementation, tiles which are 1000 m on the side (in the horizontal plane) can be utilized. The files representing the tiles would then hold all the points which belong to the particular geographic area delimited by the tile, and no other. In certain embodiments, tree structures (such as quadtrees and octrees) are implemented depending on the traversal style for the data.

Figure 16:
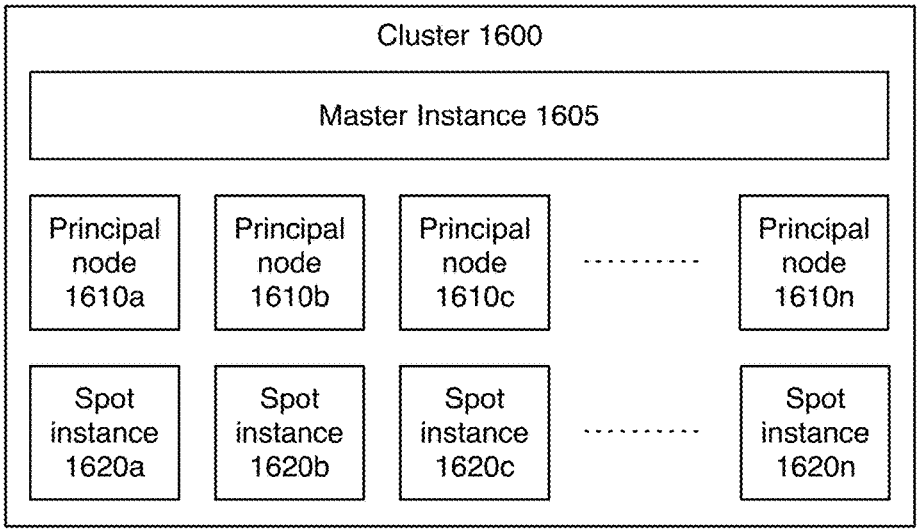
FIG. 16 is a schematic block diagram of a point-cloud processing cluster.

Processing of the data to automatically extract semantic maps from geospatial data occurs on computation clusters, implemented within processing unit 1240 (embodiments of which are described further with reference to FIG. 16, below). These have access to the point cloud and other data through the network accessible storage unit 1220. Intermediary results as well as finalized ones are stored similarly.

Figure 14:
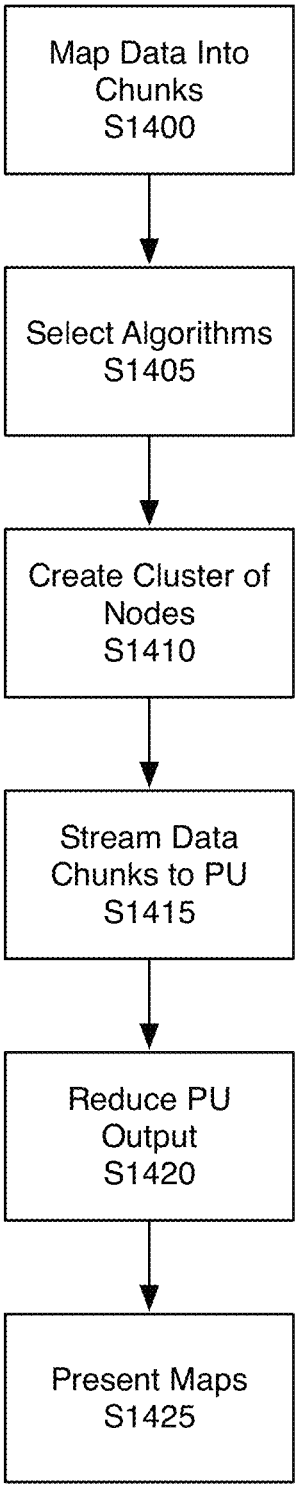
FIG. 14 is a further flow diagram of a process for analyzing point-cloud data.

FIG. 14 illustrates a process that may be performed by the apparatus of FIG. 12 upon initiation of an analysis job. In order to simplify data processing, and enable implementation of a MapReduce data analysis framework, the point-cloud data is subdivided into chunks (step S1400) by data storage/preprocessing component 1220. These chunks can be subsets of tiles or combinations thereof, potentially selected to optimize for, e.g., the desired processing method, available memory and other runtime considerations. Individual nodes in the computation cluster (i.e. within processing unit 1240) are then capable of processing geospatial and other data associated with a given data chunk, i.e., selected subsets or combinations of tiles.

Figure 15:
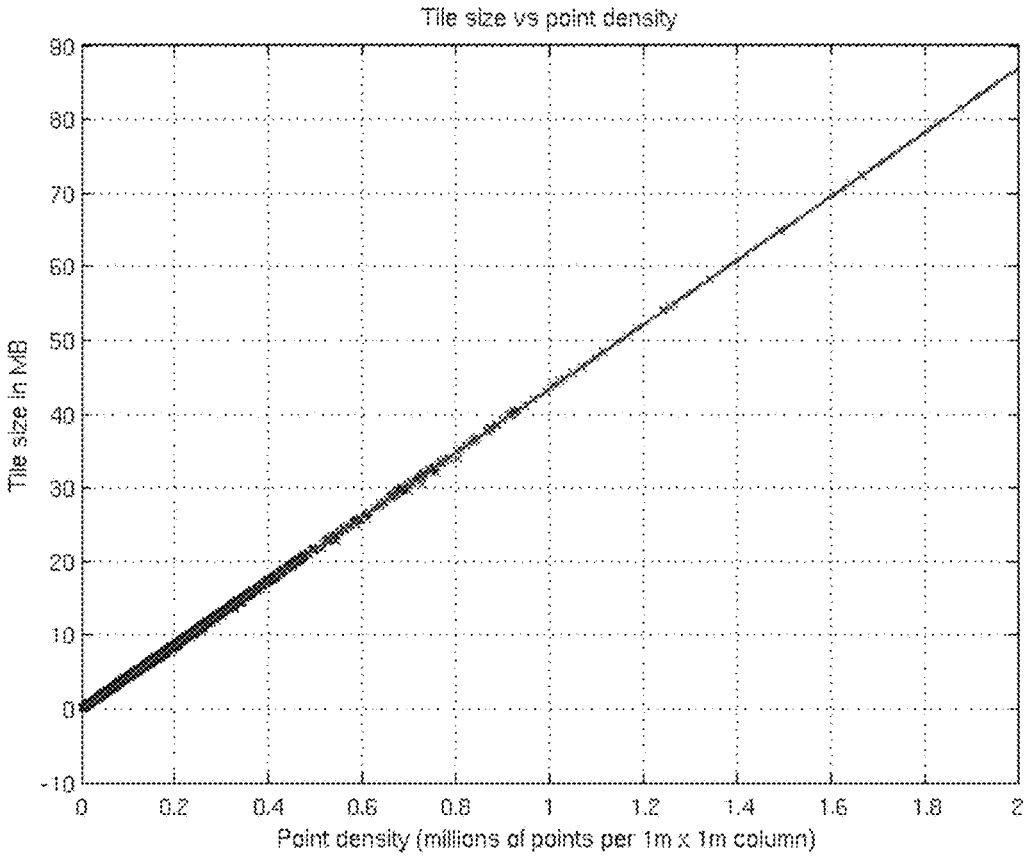
FIG. 15 is a chart illustrating point cloud tile size and density distribution in an exemplary point-cloud survey.

The density of the point-cloud may be an important factor in determining the number of tiles (or the size of tile subsets) to process within the same computation node. In an exemplary embodiment, FIG. 15 illustrates the size of tiles with respect to the number of points within (represented by the diagonal line), as well as the distribution of tiles sizes for an exemplary dataset comprising LiDAR point-cloud data measured along a 2 km section of railway (each tile represented by hatches across the diagonal line). Data storage and preprocessing component 1220 performs tile aggregation, and/or subdivision, prior to feeding data to processing unit 1240, in order to optimize the analysis performance.

Given the benefits of tile aggregation, as described above, having a reduced point-cloud density can result in reduced processing times. However, low densities generally make the feature detection process more difficult, and can result in higher rates of false positives. The richer the point-cloud data, the more accurate the detection process becomes.

Once processing is initiated, job scheduler 1225 creates a queue containing tasks pertaining to the job, as configured in steps S1305 and S1310. Job scheduler 1225 associates one or more of analysis mechanisms 1250 (typically implementing various different data analysis algorithms) with the task (step S1405), and creates a cluster of machines within processing unit 1240 to process the data (step S1410). The size of the cluster (i.e. the number of computation nodes) may be determined to satisfy the turnaround time requested in step S1310, given the previously-measured average time for a single node to implement the require data analysis mechanism(s) 1250 on a tile aggregation of known average size (e.g. 250 MB). For example, consider a sample dataset submitted for processing, estimated to take about 240 hours of compute time on an eight-core desktop computer. Since data analysis mechanisms 1250 are preferably designed to run concurrently, job scheduler 1225 can initiate a cluster of 20 machines with four cores each, and process the same dataset in approximately 24 hours instead.

Processing unit 1240 is composed of a collection of compute clusters. The size of the cluster depends on the number of jobs. FIG. 16 illustrates an exemplary compute cluster. Each cluster contains: a master instance 1605, responsible for managing the cluster; a set number of principal computation nodes 1610, which also store data in data storage system 1220; and a variable number of "spot" instances 1620. In some embodiments, it may be desirable to size principal instances 1610 to be capable of processing the entirety of the data and meeting the turnaround time requirement, with spot instances 1620 activated based on, e.g., their cost and/or job time constraints. In other embodiments, compute clusters consisting entirely of spot instances, or entirely of principal nodes, may be utilized.

Once an appropriately-configured compute cluster is generated, data storage and preprocessor component 1220 directs a stream of data chunks (e.g. aggregations of tiles satisfying a desired data subset size) to processing unit 1240 (step S1415). Principal nodes and spot instances within processing unit 1240 execute appropriate data analysis mechanisms 1250 to, e.g., extract asset or feature information from the 3D point-cloud tiles.

Once the dataset has been processed by processing unit 1240 and the desired information extracted, map generator 1230 is triggered. Map generator 1230 combines the output of nodes within processing unit 1240 into semantic maps (step S1420). Reporting analytics can be derived from the semantic maps by running queries to analyze particular assets and their combinations.

Map generator 1230 may also include an annotation integrity verifier operating to verify the integrity of annotated datasets over time. In some applications, locations may be surveyed repeatedly at different times. For example, in railway applications, trains equipped with LiDAR or other railway surveying vehicles may periodically survey the same length of railway, such as to monitor the health or status of assets along a track. In some roadway applications, LiDAR-equipped survey vehicles may travel along a given portion of road at different times. In other roadway applications, data captured by LiDAR equipped automobiles, such as autonomous driving cars, may be regularly analyzed, providing potentially frequent analyses of the local environment in a given location. Each time a new map is generated by map generator 1230 concerning a given area, asset or local feature information can be compared to such information contained in older maps. Alarms, notifications or events can be triggered when discrepancies are detected.

The output of map generator 1230 is ultimately made available to the user, via front end 1200 and map retrieval tool 1215 (step S1425). Once a job is completed and a map is generated, scheduler 1225 (monitoring the status of tasks and jobs) generates notifications for the end user.

Feature maps (containing only the location, geometry and features of various assets), as well as semantic ones can also be stored in remotely accessible geodatabases. The map data can be retrieved either directly or through a server to facilitate the querying and collection of results. The maps can be retrieved in their entirety or by selecting a specific area of interest.

Security, Compression and Integrity

The security of the data and maps may be an important aspect of many embodiments. Preferably, data upload step S1300 employs end-to-end encryption (such as AES encryption) from the user data source to the cloud computing platform. Such encryption may also be utilized for communications between a user's system and front-end 1200.

In some embodiments, it may be desirable to store raw point cloud data within data storage component 1220 in a compressed format. For example, an exemplary distributed compute cluster having one terabyte of storage for every four central processing unit (CPU) cores, storing the 3D point-cloud data in its raw form may lead to slower processing times because the storage infrastructure would be I/O bound while the CPU cores sometimes sit idle. This means the CPUs would essentially wait for data to be read from storage, before processing it. Compressing the raw point-cloud data before storing it allows the system to spend less time reading and writing data to disk. Therefore, data storage component 1220 may include a compression mechanism to compress point-cloud data before storage.

However, by storing compressed raw point cloud data, processing time is increased, because the data must be decompressed by a decompression mechanism before applying data analysis mechanisms 1250. Typically, there is a positive relationship between the compression ratio of compressed data, and the amount of processing time required to compress and decompress the data. Therefore, it may be desirable in some embodiments to continually measure CPU time and modulate data compression ratios to balance, as closely as possible, the rate at which data can be read from storage component 1220, and the rate at which that data can be uncompressed and processed by processing unit 1240.

Figure 17:
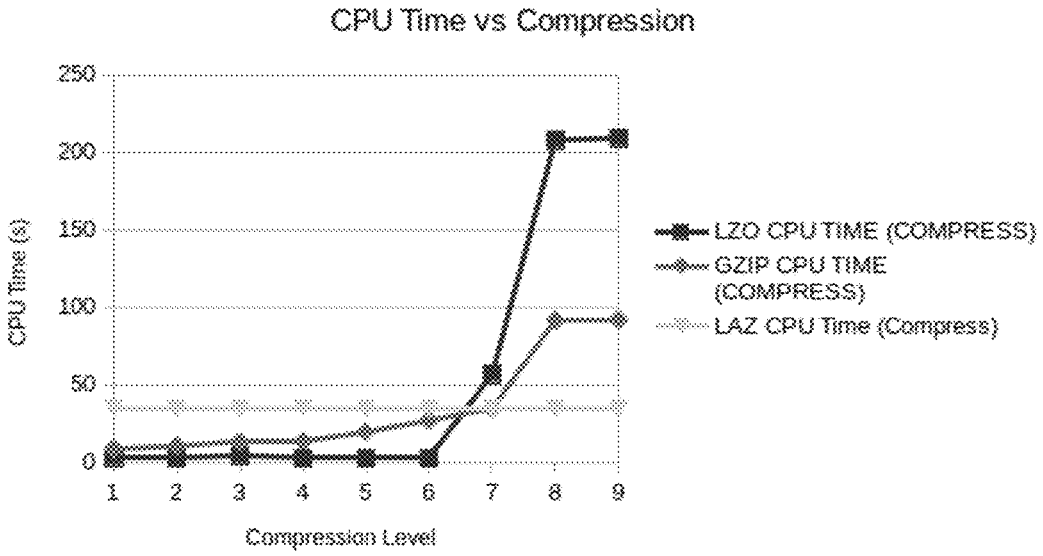
FIG. 17 is a plot of characteristics for compression mechanisms usable with point-cloud data.
Figure 18:
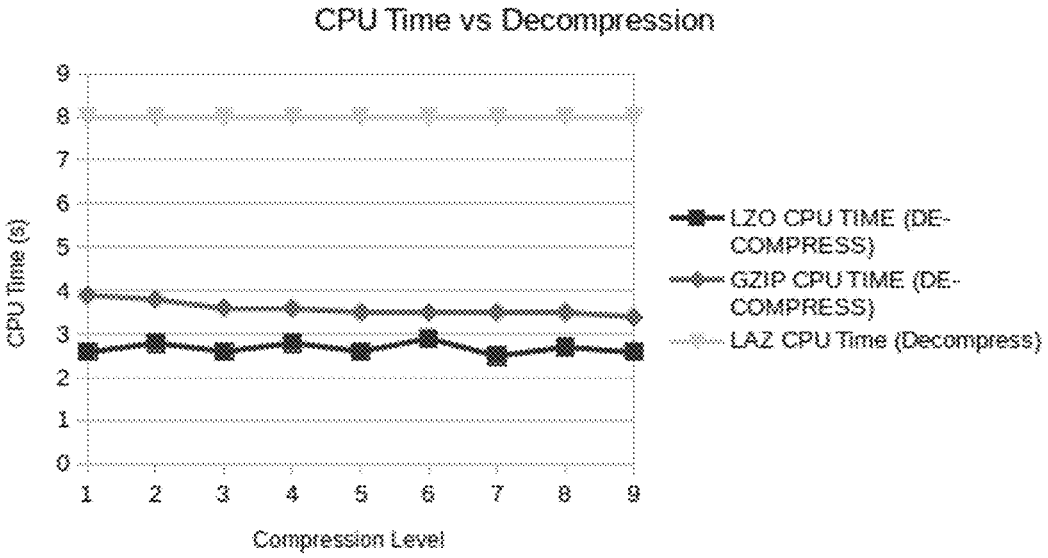
FIG. 18 is a plot of characteristics for compression mechanisms usable with point-cloud data.
Figure 19:
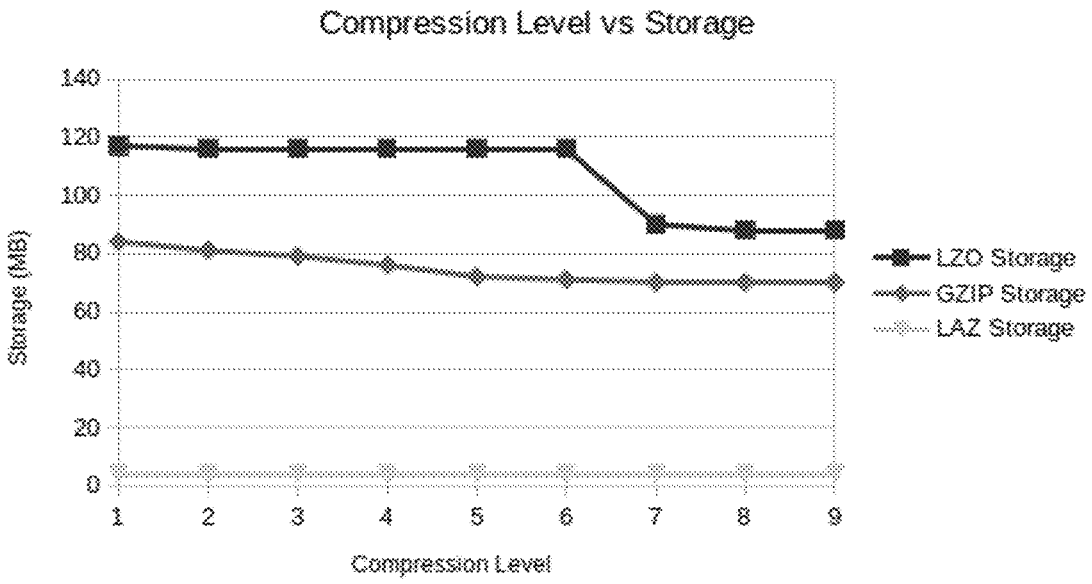
FIG. 19 is a plot of characteristics for compression mechanisms usable with point-cloud data.

Many lossless data compression mechanisms may be utilized to treat large point-cloud datasets, as described herein. Examples include LempelZivOberhumer (LZO), GZIP (also based on LempelZiv methods), and LASzip (released by rapidlasso GmbH, and hereafter referred to as LAZ). FIGS. 17, 18 and 19 show a comparative analysis of these three compression mechanisms. In terms of compression, the LAZ method presents a constant CPU time across all compression levels (the higher the compression level, the smaller the compressed output file). This method is very attractive since it results in smaller file sizes when compared to LZO and GZIP. LZO and GZIP, however, are optimized for decompression, and therefore present a superior alternative to LAZ in terms of CPU time required for decompression. In some embodiments, it may be desirable to speed up data processing while minimizing storage requirements by selecting a compression mechanism from amongst multiple mechanisms having different characteristics, based on the nature of dataset and the characteristics (such as cost and availability) of available computing infrastructure.

Machine Vision Analysis Mechanisms

Data analysis mechanisms 1250 are typically selected based on the nature of the information desired to be extracted from the point-cloud data. It may be desirable to design mechanisms 1250 with very low false positive rates, while maintaining acceptable detection rates. For added confidence in generated maps, in some applications, a subset of results may be verified manually by inspecting the original point-cloud and raw imaging data.

Track Detection and Traversal

In embodiments processing railway point-cloud survey data, track detection may be an important first step. Track detection can be important because knowledge of the track position facilitates identification of assets, since regulations often assign specific locations for each asset in relation to the track.

Figure 20:
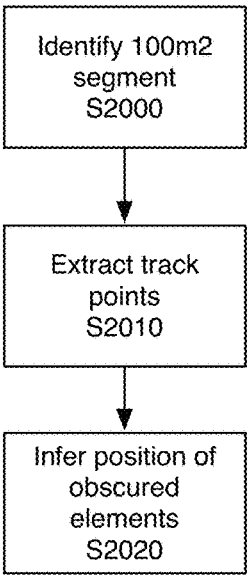
FIG. 20 is a flow diagram of a process for track detection.

FIG. 20 illustrates a process for track detection and traversal that can be implemented by processing unit 1240, e.g. in step S1415 of FIG. 14. In step S2000, a 100 m×100 m section of point-cloud data is identified for analysis. In step S2010, the geometry of the 10,000 $m^2$ point cloud section is analyzed to extract a subset of points which are associated with the track. Many techniques can be employed to achieve the desired result. In some embodiments, previously-classified tracks from similar data sets can be studied to identify properties of data in the vicinity of the tracks, with those properties serving as an indicia of track location in newly-analyzed data. Other techniques include projecting points in two-dimensional space (based on, e.g., height or pulse intensity) and utilizing edge detection mechanisms and transforms to isolate regions belonging to the track. In an exemplary use case, the 10,000 $m^2$ point cloud section in step S2000 may consist of about 1 GB of data, while the extracted track subset output in step S2010 may consist of about 1 MB of data.

Figure 21:
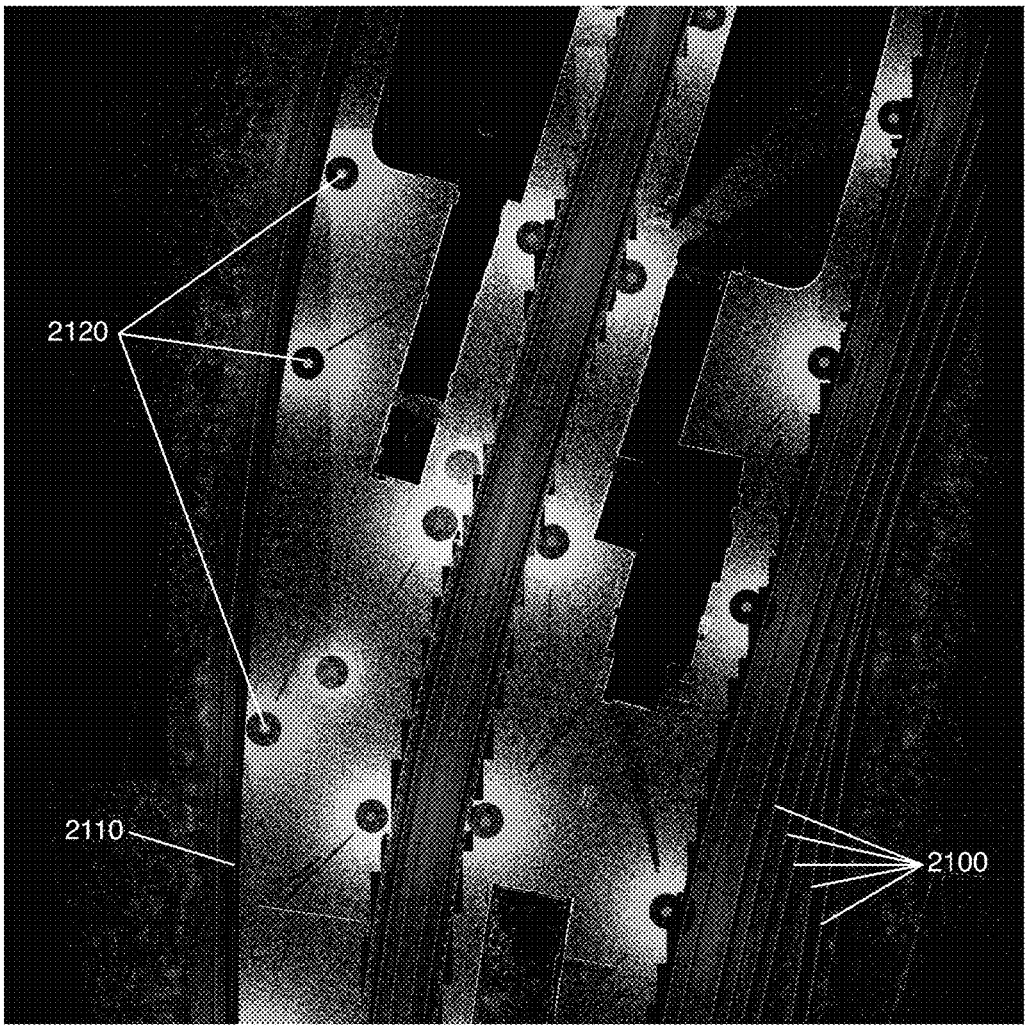
FIG. 21 is a visualization of a point-cloud section with extracted rail information.

FIG. 21 is a visualization of the 10,000 m2 point cloud section input to step S2000, and the extracted rail data output in step S2010. Lines 2100 represent track that is visible in the point-cloud. Line 2110 represent track that was obscured during the LiDAR data collection process, having a position that is estimated. This is typically the result of shadowing, a process which occurs when the object of interest is hidden from direct line of sight of the measuring instrument. Dots 2120 correspond to problematic positioning of a LiDAR tripod system which resulted in some track sections being obstructed. The location of the invisible track can be inferred by utilizing known spatial continuity properties of the infrastructure (such as spacing relative to other observed elements) (step S2020).

Figure 22A:
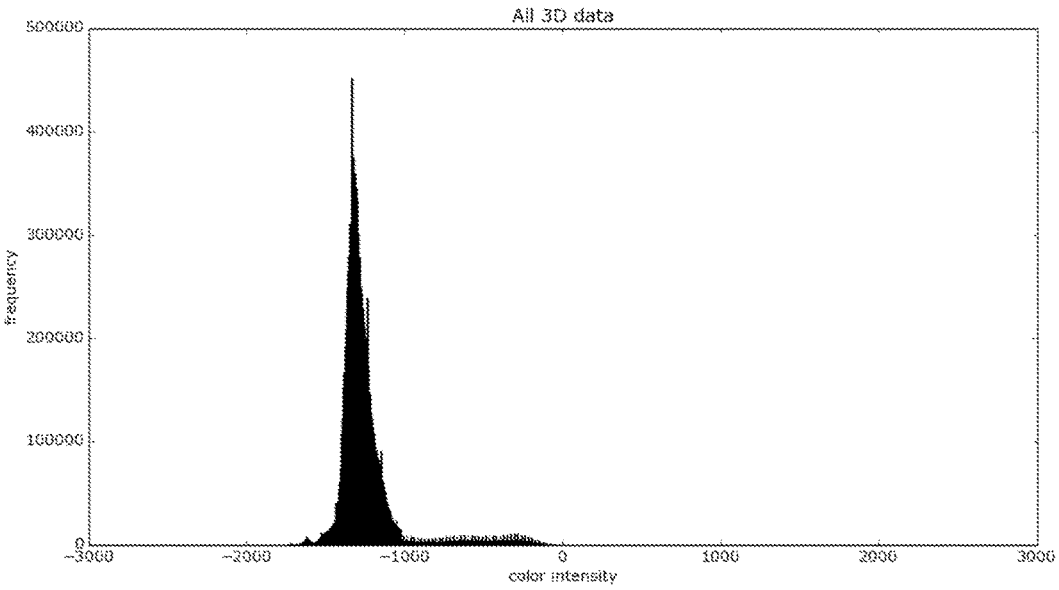
FIG. 22A is a histogram of point-cloud intensity levels in an exemplary point-cloud segment.
Figure 22B:
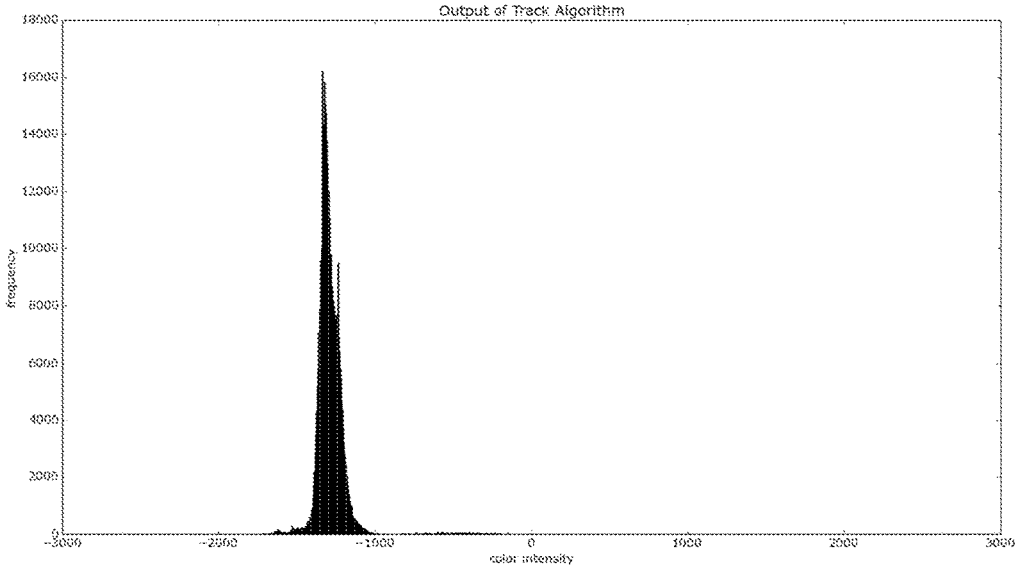
FIG. 22B is a histogram of point-cloud intensity levels in an exemplary point-cloud segment.

Geospatial data presents many dimensionalities that can be taken advantage of during asset extraction. Imagery, infrared, video feeds and/or multispectral sensors can be combined to increase detection confidence and accuracy. Most LiDAR systems include an intensity measurement for each point. By analyzing the intensity of points both on and off the track, classification mechanisms and filters can be added to the system, for an increased track detection rate. FIGS. 22A and 22B are histograms of point-cloud intensity levels in an exemplary track detection implementation. FIG. 22A illustrates quantity of each measured intensity level in an analyzed body of point cloud data, as a whole. FIG. 22B illustrates the same histogram, for points within the point cloud identified as corresponding to track. A simple band pass filter can be effective in some cases to further narrow a search space for points belonging to the rail. Other classification methods can also be utilized.

Figure 23:
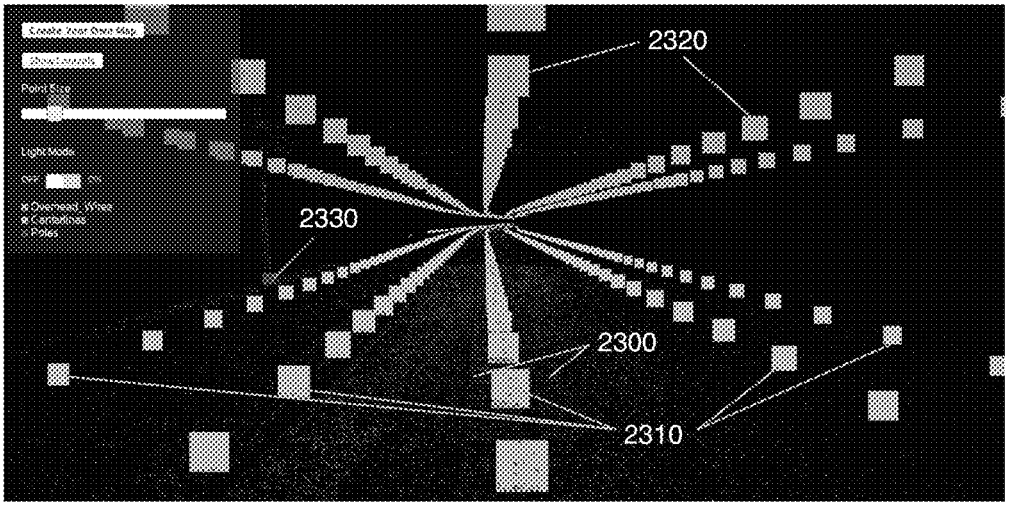
FIG. 23 is a visualization of track detection mechanism output.

FIG. 23 is a visualization of a portion of the output of an implementation including a track detection mechanism and other asset detection mechanisms. Via operation of the track detection mechanism, track segments 2300 are identified first, then for each track, centerline markers 2310 are established. Once the tracks and track centerlines are identified, subsequent analysis components can traverse the track within the point-cloud data, while enjoying a 360 degree view of high resolution point cloud data around each point in the centerline.

Other analysis mechanisms identify and locate other assets or features for inclusion in a sematic map. For example, an overhead wire detection mechanism identifies and locates overhead wires, and demarcates them with overhead wire centerline indicia 2320. A pole detection mechanism identifies and locates trackside poles, and locates them with indicia 2330. These and other features may be included in semantic map output generated via the systems and methods described herein.

In some embodiments, analysis mechanisms may be applied sequentially, with an output of one mechanism serving as an input to another mechanism. For example, in railway applications, assets and elements of the local environment regularly are replaced, added, removed or shifted. It may be desirable to regularly check clearance above and around a track to ensure safe operation, and that train cars do not come into contact with any obstructions. In such an application, a track detection mechanism, such as that described above, may be implemented as part of a sequence of analysis mechanisms. The output of a track detection mechanism that includes the track centerline may be subsequently used as an input to a track clearance check mechanism. A bounding box is defined with respect to the track center line, and any objects that encroach within that bound are reported. The dimensions of the bounding box can be modified to fit various standards.

Determining the location of signs, signals, switches, wayside units, and the like is also possible using the detection framework. Once localized, the classification of these assets is rendered possible given the geometric features of each asset, according to manufacturer's specifications or other object definitions.

Another analysis mechanism that may be beneficially employed in a railway application is overhead line inspection. Overhead wires can be identified within point-cloud data. The height of the wire in comparison with the track is assessed. Areas with saggy lines are reported. By using pole location information, the catenary shape of the wire can also be assessed.

While certain analysis components are described in the context of railway track detection, it is contemplated and understood that similar analysis mechanisms and methods may be utilized to identify other types of assets, potentially in other applications. For example, mechanisms analogous to the track detection mechanism described herein may be useful in a roadway context for identifying lane markings and/or curbs.

Computing Paradigms

The automated extraction of maps can be achieved by combining computation blocks into directed acyclic graphs (hereafter referred to as "graphs"). The blocks contained in these graphs have a varying degree of complexity, ranging from simple averaging and thresholding to transforms, filters, decompositions, etc. The output of one stage of the graph can feed into any other subsequent stage. The stages need not run in sequence but can be parallelized given sufficient information per stage. When creating feature maps, a graph is generally used to classify points within a point cloud belonging to the same category, or to vectorize. Vectorization refers to the creation of an (often imaginary) line or polygon going through a set of points delimiting their center, boundary, location, etc. As such, computation graphs can be used to implement classifiers, clustering methods, fitting routings, neural networks and the like. Rotations and projections are also used, often in conjunction with machine vision processing techniques.

To take full advantage of distributed computing, the creation of semantic maps from geospatial data may be parallelized. There are many levels of parallelization that can be implemented. At the highest level, the survey data can be divided into regularly-shaped regions of interest which get streamed to different machines and CPU processes. The results coming from each area need to then be merged in a "reduce" step once all the processes finish, similarly to the process of FIG. 14. Since boundary conditions arise, padding the regions of interest with extra data which is truncated at the end of the process usually removes those deformities near the edges. The size of the region of interest, as well as the padding thickness is determined by the graph extracting the assets or features.

At another level, parallelism can occur when processing is taking place along a pre-extracted vector. For example, when searching for signs in the vicinity of a railroad track, the data can be traversed by extracting regions around waypoints along the previously extracted track centerline. Multiple processes can then be used in parallel along different waypoints of the track.

Finally, when analyzing a particular region, each point can be considered individually. In this traversal method, a voxel surrounding that point is usually extracted and analyzed. This process can also be made parallel, in those cases when the outcome of one point's operation does not affect that of any other point.

These are some of the traversal methodologies employed in the map creation process, and some of the ways in which data processing can be made parallel. In addition, the use of GPU (graphics processing units), in conjunction with the conventional CPUs also carries great speed improvements and can further assist in reducing turnaround times.

Geospatial data is not limited to point cloud, but extends to imagery, video feeds, multispectral data, RADAR, etc. For increased mapping accuracy and correctness, some embodiments may utilize any additional data sources that are available. Several techniques can be utilized for using data from different sources. In some embodiments, datasets can be combined in a pre-processing stage (e.g. step S1400), before feeding into the computation graphs. This approach provides computation graphs with data from multiple sources for processing. In other embodiments, one set of data may be used to generate a hypothesis concerning an asset and its properties; data from other sources can then be used to validate and/or augment the hypothesis via other analysis mechanisms.

Machine Learning:

Many machine learning techniques can be implemented to assist in the semantic map creation process. Existing annotated maps can be used to train graphs and optimize them, to automatically generate accurate semantic maps from geospatial data. The input data to the machine learning system is comprised of survey data, as well as the corresponding, annotated output maps. The output of the machine learning system is a refined graph, which can then be applied to more extensive survey data, in order to extract maps at scale. In some instances, classified point clouds (where a category is assigned to each point based on which asset it belongs to) are used to feed into the training process. In others, vectorized maps are used to learn the map creation process and tune the processing graphs. These methods fall under the supervised learning category, relying on evaluating performance (through error measurement) and reinforcement of desirable performance.

Figure 24:
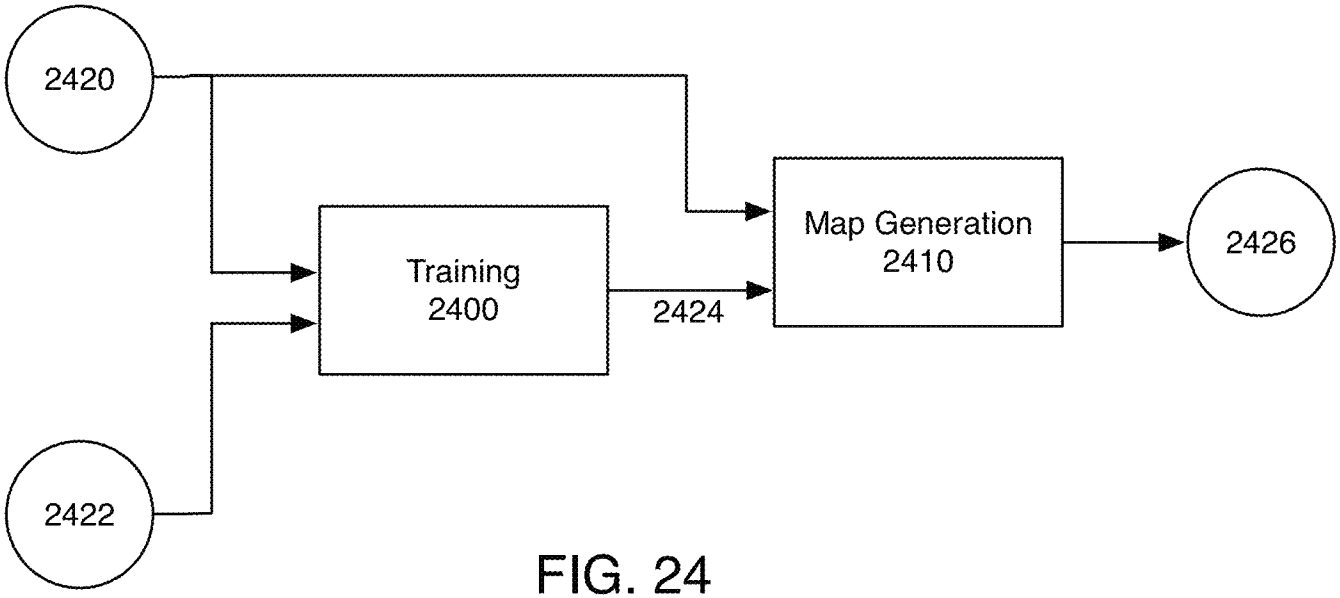
FIG. 24 is a schematic block diagram of a map generation system utilizing supervised machine learning.

FIG. 24 illustrates an embodiment of a system implementing supervised machine learning, including training component 2400 and map generation component 2410. Training component 2400 receives as inputs, raw point cloud data 2420 and sample output 2422. In some circumstances, sample output 2422 may be verified output data associated with approximately 1% of the total data set. Sample output 2422 may include classified point cloud data (where points belonging to a particular asset category are grouped together), and/or a vectorized map (with points, lines and polygons drawn over assets of interest). Training component output 2424 defines an optimized categorization mechanism, such as algorithm coefficients for an analysis mechanism comparable to mechanisms 1250 in the map generation system of FIG. 12. Training component output 2424 may also define a region of interest for the algorithms to be most effective, define functional blocks within a computation graph which should be utilized, and/or define features of interest for a particular asset under consideration. Training component output 2424 is fed into map generation component 2410, along with the full corpus of raw point cloud data 2420. Map generation component 2410 then operates to generate map output 2426.

Unsupervised methods can also be implemented for generating maps. Such processes can rely on scale-dependent features to describe contextual information for individual map points. They can also rely on deep learning to design feature transformations for use with map point features. Ensembles of feature transformations generated by deep learning are used to encode map point context information. Asset membership for points can then be based on features transformed by deep learning algorithms. Another method revolves around curriculum-based learning where assets are described in a curriculum, then learned in computation graphs. This method can be effective when the assets of interest are regular in shape and properties, and do not exhibit a lot of spatial complexity.

With these learning schemes, a neural network is often trained in a primary step, then applied to the remainder of the geospatial data for extraction of the map.

Machine learning techniques can therefore assist in optimizing and refining computation graphs. These graphs can be engineered manually or learned using the above methods. A parameter search component is useful for accuracy improvements and reductions in false positives and negatives. In this step, various parameters of the computation graph (from the region of interest, to the parameters of each function, to the number and nature of features used in a classifier) can all be modulated and the output monitored. By using search methodologies, the best performance combination of parameters can be found and applied to the remainder of the data. This step assumes the availability of previously annotated semantic maps.

When computation graphs are refined to an acceptable performance level, they can be used directly in the vehicles. This would correspond to streaming of the intelligence from the cloud to the vehicles, as opposed to the more conventional streaming of data from local environments to cloud systems. With geospatial data, the sheer size of the sensor data can be prohibitive. Therefore, in some embodiments, locally-obtained sensor data (e.g. data obtain by vehicle-mounted sensors) is summarized via local computation resources, with only a subset of collected information and/or extracted content being sent back to remote data systems. For example, resources comparable to data storage/preprocessor component 1220, processing unit 1240 and data analysis mechanisms 1250, can be implemented in-vehicle to extract semantic map data from onboard sensor systems. Computation graphs analogous to those described above for implementation in a cloud-based processing structure, can be optimized and tested in a machine learning framework, while presenting an opportunity for local in-vehicle implementation. Such embodiments can utilize the vehicles as a distributed computing platform, constantly updating the contents of a centrally-maintained map, while consuming most of the remotely-sensed data in place, rather than streaming all of it to a central, cloud-based system.

While machine learning implementations described herein can tremendously accelerate the development of new graphs to map new features and assets, learning exercises can sometimes suffer from a shortage of training data, and issues with respect to accuracy. The consequence of these issues can include over-fitting and performance ceilings. When the amount of training data is limited, the learning routines might skew the graph's performance heavily towards the little data which is available, making it prone to fail when new cases are introduced which have not been trained for. Concerning performance, the creation of maps for training data is typically a manual process which is prone to error. As such, when the training data itself is not entirely accurate, the resulting graph won't be accurate either. For example, if a GIS analyst achieved only 80% accuracy of assets in their manually generated map, then any graph which has been trained on that data will have a very hard time crossing the 80% threshold of accuracy.

To address these issues, a simulation environment can be utilized. In the simulation environment, maps are programmatically generated in large numbers of permutations of parameters, to replicate the variability of terrains and landmarks on the face of the planet. Three dimensional models are then generated from the maps and raytraced to create a point cloud in as similar a way to real data collection as possible. Since the location of every asset is known a priori, a perfect map extracted from the point cloud is then available. The variability of the data, and the fact that a perfect ground truth exists for each point cloud greatly increases the scope of the computation graphs and their accuracy. It also provides a mechanism to understand the limitations of the current computing paradigms.

However, no matter how much a graph is trained, and how many test cases it undergoes, an automated map extraction can never be ideal. For this reason, a manual quality control (QC) step can be introduced to help find any issues. To avoid having to perform QC over the entire map, a level of confidence can be generated during the map making process. This level represents how confident a graph was in extracting the desired features from a map. QC can then be performed on regions in the lowest percentiles of confidence.

Quality control can be performed in multiple ways. Similar to creating a semantic map, a GIS analyst can use conventional visualization tools and overlay the raw survey data with the automatically extracted map. Any discrepancies can then be identified and corrected. Another method for QC would be to crowd source the effort amongst multiple agents online. Since each one of those agents might not be entirely skilled in semantic map creation, the QC work would need to be replicated. Hypotheses can then be confirmed or denied by each QC result, and a final conclusion reached with enough trials.

It is important to garner the QC results to reinforce the computation graphs. When discrepancies are detected, newly simulated worlds can be utilized that include the problematic test case. Further retraining of the graphs may then account for the use case in future work.

While certain embodiments have been described herein in detail for purposes of clarity and understanding, the foregoing description and Figures merely explain and illustrate the present invention and the present invention is not limited thereto. It will be appreciated that those skilled in the art, having the present disclosure before them, will be able to make these and other modifications and variations to that disclosed herein without departing from the scope of any claims.

What is claimed is:

1. A computer-implemented cloud computing system for mapping assets within point-cloud survey data, the system comprising:

a front end component accessible via a digital communications network for receiving a point-cloud dataset procured by local environment sensors installed within a plurality of remote vehicles;

a data storage component, the data storage component storing the point-cloud dataset and subdividing the point-cloud dataset into a plurality of data chunks, each data chunk comprising (a) data associated with a region-of-interest within the point-cloud dataset at least partially bounded by regions-of-interest associated with other data chunks, and (b) a padding region about region-of-interest;

a processing unit comprising a compute cluster with a plurality of computation nodes, the processing unit receiving streamed data chunks from the data storage component and distributing the data chunks amongst the computation nodes for parallel application of one or more analysis mechanisms to each data chunk to extract asset information; and a map generator combining asset information extracted from the data analysis mechanisms into an output map comprising a collection of vectors in a coordinate frame representing an area under observation, for use by other remote vehicles.

2. The computer-implemented cloud computing system of claim 1, in which each data chunk comprises one or more tiles of point-cloud data.

3. The computer-implemented cloud computing system of claim 2, in which each tile comprises a subset of point-cloud data within a rectangular column extending lengthwise along the Earth's gravity vector.

4. The computer-implemented cloud computing system of claim 3, in which each data chunk contains a number of contiguous tiles optimized to achieve a target data chunk size.

5. A computer-implemented cloud computing system for mapping assets within point-cloud survey data, the system comprising:

a front end component accessible via a digital communications network for receiving a point-cloud dataset procured by local environmental sensors installed within one or more remote vehicles;

a data storage component, the data storage component storing the point-cloud dataset and subdividing the point-cloud dataset into a plurality of data chunks;

a processing unit comprising a compute cluster, the processing unit receiving streamed data chunks from the data storage component and applying one or more analysis mechanisms to each data chunk to extract asset information; and a map generator combining asset information extracted from the data analysis mechanisms into an output map for use by other remote vehicles;

in which the map generator further comprises an annotation integrity verifier comparing asset information in an output map with asset information in one or more prior output maps corresponding to a common local environment, to generate a notification when discrepancies are detected.

6. A computer-imlemented cloud computing system for mapping assets within point-cloud survey data, the system comprising:

a front end component accessible via a digital communications network for receiving a point-cloud dataset procured by local environment sensors installed within one or more remote vehicles;

a data storage component, the data storage component storing the point-cloud dataset and subdividing the point-cloud dataset into a plurality of data chunks;

a processing unit comprising a compute cluster, the processing unit receiving streamed data chunks from the data storage component and applying one or more analysis mechanisms to each data chunk to extract asset information;

a map generator combining asset information extracted from the data analysis mechanisms into an output map for use by other remote vehicles;

a compression mechanism operating to compress the point-cloud data prior to storage within the data storage component; and a decompression mechanism operating to decompress the point-cloud data prior to application of the analysis mechanisms by the processing unit;

whereby the compression mechanism modulates its compression ratio to balance a data retrieval rate from the data storage component, with a data processing rate achievable by the processing unit.

* * * * *